US007533957B2

(12) United States Patent
Kaneko et al.

(10) Patent No.: US 7,533,957 B2
(45) Date of Patent: May 19, 2009

(54) IMAGE FORMING APPARATUS

(75) Inventors: Tetsuya Kaneko, Kanagawa (JP); Kunihiro Yamanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 355 days.

(21) Appl. No.: 10/586,798

(22) PCT Filed: Dec. 1, 2005

(86) PCT No.: PCT/JP2005/022504

§ 371 (c)(1),
(2), (4) Date: Jul. 19, 2006

(87) PCT Pub. No.: WO2006/059792

PCT Pub. Date: Jun. 8, 2006

(65) Prior Publication Data

US 2008/0238982 A1 Oct. 2, 2008

(30) Foreign Application Priority Data

Dec. 1, 2004 (JP) ..... 2004-347937

(51) Int. Cl.
*B41J 2/165* (2006.01)
*B41J 2/01* (2006.01)

(52) U.S. Cl. ..... 347/22; 347/29; 347/32; 347/33; 347/104

(58) Field of Classification Search ..... 347/22–36, 347/100, 102, 104, 106
See application file for complete search history.

(56) References Cited

U.S. PATENT DOCUMENTS 5,270,738 A * 12/1993 Takahashi et al. ..... 347/24

FOREIGN PATENT DOCUMENTS

| | | |
|---|---|---|
| JP | 04-201469 | 7/1992 |
| JP | 04-344255 | 11/1992 |
| JP | 06-031929 | 2/1994 |
| JP | 08-156284 | 6/1996 |
| JP | 09-254460 | 9/1997 |
| JP | 2897960 | 3/1999 |
| JP | 2000-025249 | 1/2000 |
| JP | 2000-246981 | 9/2000 |
| JP | 2000-272116 | 10/2000 |
| JP | 2001-180012 | 7/2001 |
| JP | 3329367 | 7/2002 |
| JP | 2002-248780 | 9/2002 |
| JP | 2003-089226 | 3/2003 |
| JP | 2003-205633 | 7/2003 |
| JP | 2003-231265 | 8/2003 |
| JP | 2004-182392 | 7/2004 |
| JP | 2004-284084 | 10/2004 |

* cited by examiner

*Primary Examiner*—Shih-Wen Hsieh
(74) *Attorney, Agent, or Firm*—Cooper & Dunham, LLP

(57) ABSTRACT

An image forming apparatus comprising: a recording head having a nozzle configured to eject a liquid drop of recording liquid so as to form an image on the recording-medium with a liquid drop ejected from the nozzle of the recording head; a conveyer configured to electrostatically hold and convey a recording-medium by a charge provided to the conveyer; and a cleaning device configured to clean a nozzle face of the recording head based on a tolerance threshold value of contamination of the nozzle face generated by the ejection of a liquid drop and the number of liquid drops ejected from the recording head for image formation.

20 Claims, 19 Drawing Sheets

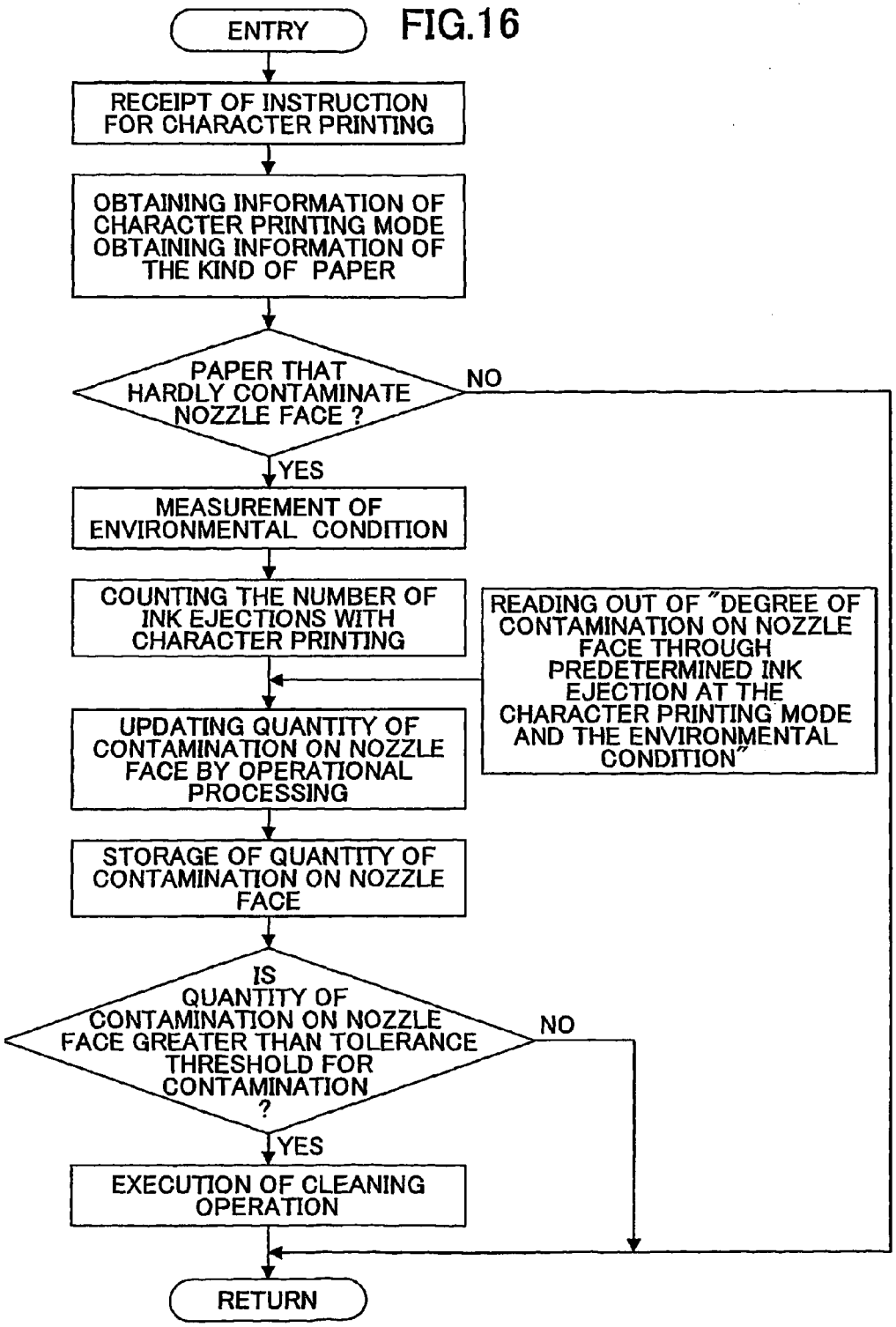
FIG.16
ENTRY
RECEIPT OF INSTRUCTION FOR CHARACTER PRINTING
OBTAINING INFORMATION OF CHARACTER PRINTING MODE OBTAINING INFORMATION OF THE KIND OF PAPER
PAPER THAT HARDLY CONTAMINATE NOZZLE FACE ?
NO
YES
MEASUREMENT OF ENVIRONMENTAL CONDITION
COUNTING THE NUMBER OF INK EJECTIONS WITH CHARACTER PRINTING
READING OUT OF "DEGREE OF CONTAMINATION ON NOZZLE FACE THROUGH PREDETERMINED INK EJECTION AT THE CHARACTER PRINTING MODE AND THE ENVIRONMENTAL CONDITION"
UPDATING QUANTITY OF CONTAMINATION ON NOZZLE FACE BY OPERATIONAL PROCESSING
STORAGE OF QUANTITY OF CONTAMINATION ON NOZZLE FACE
IS QUANTITY OF CONTAMINATION ON NOZZLE FACE GREATER THAN TOLERANCE THRESHOLD FOR CONTAMINATION ?
NO
YES
EXECUTION OF CLEANING OPERATION
RETURN

IMAGE FORMING APPARATUS

TECHNICAL FIELD

The present invention relates to an image forming apparatus, and particularly, an image forming apparatus for forming an image by ejecting recording liquid while a recording-medium is electrostatically conveyed.

BACKGROUND ART

As an image forming apparatus such as a printer, a facsimile machine, a copying machine and a complex machine thereof, for example, an ink jet recording apparatus is known. The ink jet recording machine performs recording (that is synonymous with image formation, picture printing, character printing, printing, and the like) by ejecting an ink drop from a recording head onto a recording-medium such as a recording paper (referred to as a "paper" below, but the medium is not limited to a paper, and the medium can be also referred to as a recording-medium, a transcription paper, a transcription medium, recording material, or the like). The ink jet recording machine has some advantages of having the capability of recording a high-definition image at high speed, low running cost, low noise, and further, easily recording a color image using multi-color inks.

In such an ink jet recording apparatus, it is necessary to increase the precision of the landing position of an ink drop on a paper for the attainment of high image quality. Therefore, for example, it is known to prevent jams or contamination caused by the contact of a recording head with a paper by uniformly and positively charging a conveyer belt for conveying the paper so as to hold the paper due to electrostatic attraction force, to keep the distance between the recording head and the paper constant, to control the conveyance of the paper accurately to prevent the displacement of a paper, and to prevent floating of the paper, as disclosed in Japanese Laid-Open Patent Application No. 4-201469, Japanese Laid-Open Patent Application No. 9-254460, and Japanese Laid-Open Patent Application No. 2000-25249.

However, it is known that, as the conveyer belt is thus uniformly and positively charged to hold the paper due to the an attraction force, an ink drop ejected from the recording head is influenced by an electric field so that the displacement of the landing position of the ink drop on the paper is caused and ink mist flows back to the side of the recording head.

In order to prevent the displacement of the landing position of an ink drop or the flowing back of ink mist, it is known that, to the surface of the paper on a conveyer belt having a surface charged with an uniform charge, a charge with a polarity opposing that of the conveyer belt is applied at the upstream side in directions for conveying a recording head so that the electric potential of the surface of the paper is lowered and the influence of the electric field on the ejected ink drop is reduced, and the electric potential with the same polarity as that of the surface of the conveyer belt is lowered from the side of the paper so that the holding of the paper to the conveyer belt due to the attraction force is improved, as disclosed in Japanese Laid-Open Patent Application No. 2000-25249.

Further, as a method for charging a conveyer belt, it is known that an alternating charging pattern is formed by contacting a surface of the conveyer belt with a voltage application device and alternately applying a positive charge and a negative charge in a strip-shaped manner on the surface of the conveyer belt, as disclosed in Japanese Patent No. 2897960.

As described above, when a paper is held by electrostatic attraction force, an electric field is provided between a surface of the paper and the recording head. Therefore, there are problems in that an ink drop ejected from the recording head is polarized by the influence of the electric field so that the traveling of the ink drop is disturbed and thus recording cannot be performed well, and also, ink mist caused by the traveling of ink drops flows back to near or adheres to an ejection portion of the head (a nozzle face formed on the nozzle) as a result of the polarization of the ink drop.

To address these problems, charges in an alternating charging (positive charging and negative charging due to an alternate current) pattern are applied to the conveyer belt and, as a result, an attraction force is generated between the paper and the conveyer belt as disclosed in Japanese Patent No. 2897960. Simultaneously, positive charges and negative charges induced alternately on the surface of the paper are conveyed so that the influences of the positive charges and the negative charges are canceled by each other so as to reduce the average electric potential on the surface of the paper. Then, the electric field that causes the displacement of the landing position of the ink drop and the flowing back of the ink mist is reduced.

Meanwhile, the use of a pigment-containing ink, in which an organic pigment or carbon black is used, is being studied or is in use as a coloring agent in a recent image forming apparatus using ink in order to attain high quality character printing on normal paper. Since a pigment is different from a dye and has no or little solubility to water, the pigment is normally mixed with a dispersing agent and is used in aqueous ink on the condition that the pigment is stably dispersed in water through a dispersion process. Such a pigment-containing ink generally has a viscosity higher than that of a dye-containing ink and the viscosity of the pigment-containing ink drastically varies within a range of 5 mPs through 20 mPs.

A drop of such highly viscous ink is deformed into a cylindrical shape such that it instantaneously extends long in ejection directions after a main drop of ink is ejected. Then, a phenomenon of dielectric polarization occurs such that a charge on the conveyer belt induces an opposite charge on a portion of the ink drop which portion is closest to the conveyer belt and a charge further opposite thereto, that is, a charge with the same polarity as the charge on the belt on a portion of the ink drop which portion is furthest from the conveyer belt. In another moment, the dielectrically polarized ink cylinder is divided into ink at the side of the conveyer belt which become a drop shape and ink at the side of the head which returns to the inside of the nozzle. At this time, an intermediate portion of the ink cylinder is divided more finely and become tailing ink mist. Since the trailing ink mist has the same charge as the charge on the conveyer belt, the mist is repelled by the belt and adheres to and often contaminates the nozzle face.

Consequently, the problem still remains that the adhesion of ink mist to a nozzle face of a recording head cannot be eliminated by only the conventional charging control for a conveyer belt in an image forming apparatus using such a highly viscous recording liquid.

BRIEF SUMMARY

In an aspect of this disclosure, an image forming apparatus is provide to improve image quality by effectively reducing the contamination on a head nozzle face.

In another aspect of this disclosure, there is provided an image forming apparatus that uses a highly viscous recording liquid and electrostatic conveyance, which apparatus may improve image quality by effectively reducing the contamination on a head nozzle face.

In an exemplary embodiment, there is provided an image forming apparatus including a recording head having a nozzle configured to eject a liquid drop of recording liquid so as to form an image on the recording-medium with a liquid drop ejected from the nozzle of the recording head, a conveyer configured to electrostatically hold and convey a recording-medium by a charge provided to the conveyer, and a cleaning device configured to clean a nozzle face of the recording head based on a tolerance threshold value of contamination of the nozzle face generated by the ejection of a liquid drop and the number of liquid drops ejected from the recording head for image formation.

In another exemplary embodiment, there is provided an image forming apparatus including a recording head having a nozzle configured to eject a liquid drop of recording liquid and a conveyer configured to electrostatically hold and convey a recording-medium by a charge provided to the conveyer, the image forming apparatus being capable of forming an image on both faces of the recording-medium with a liquid drop ejected from the nozzle of the recording head, wherein a frequency of cleaning of a nozzle face of the recording head when images are formed on both faces of the recording-medium is less than a frequency of cleaning of the nozzle face of the recording head when an image is formed on one face of the recording-medium.

One of the advantages that can be obtained by the above-mentioned image forming apparatus is that image quality can be improved by effectively eliminating contamination on a nozzle face which contamination is caused by mist generated in electrostatic conveyance.

Another advantage that can be obtained by the above-mentioned image forming apparatus is that image quality can be improved by effectively and efficiently eliminating contamination on a nozzle face which contamination is caused by mist generated in electrostatic conveyance in double-sided printings in which the contamination on the nozzle face is relatively low.

BRIEF DESCRIPTION OF THE DRAWINGS

FIG. 16 is a flowchart illustrating the fifth embodiment of a process of eliminating contamination caused by mist which process is performed by the control part.

EXPLANATION OF LETTERS OR NUMERALS

Figure 1:
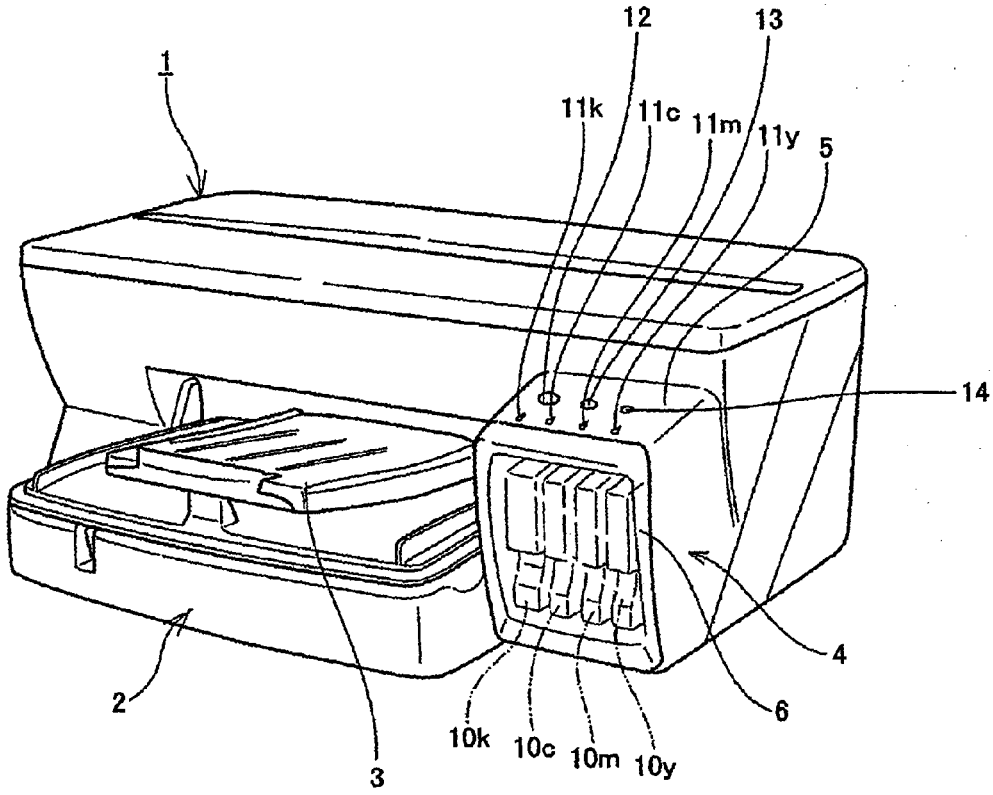
FIG. 1 is a perspective view of an example of an image forming apparatus according to the present invention seen from the front side thereof.

10: Ink cartridge
33: Carriage
34: Recording head
35: Sub-tank
51: Conveyer belt
52: Conveyer roller
53: Idler roller
56: Charging roller
81: Maintenance or restoring mechanism
82: Gap
83: Wiper blade
84: Blank ejection receiver
300: Control part
315: AC bias supplying part
317: Maintenance or restoring mechanism driving part
322: Environmental sensor

BEST MODE FOR CARRYING OUT THE INVENTION

Embodiments of the present invention are described by referring to the appended drawings below.

FIG. 1 is a perspective view of an example of an image forming apparatus according to the present invention seen from the front side thereof.

This image forming apparatus includes an apparatus body 1, a paper feed tray 2 for feeding a paper to the apparatus body 1 which tray is attached thereto, and a paper ejection tray 3 for stacking paper on which an image is recorded (formed) which tray is attached to the apparatus body 1 detachably. Further, at one side of the front face of the apparatus body 1 (one lateral side of the paper feed and paper ejection trays), a cartridge installation part 4 for installing an ink cartridge which part projects from the front face to the front side of the apparatus body 1 and is located below the top face thereof is provided and an operation/indication part 5 on which an operation buttons and an indicator are provided is made on the top face of the cartridge installation part 4.

Plural ink cartridges 10*k*, 10*c*, 10*m*, and 10*y* which are recording liquid cartridges for containing recording liquids with colors different from each other, for example, black (K) ink, cyan (C) ink, magenta (M) ink, and yellow (Y) ink (the cartridges referred to as "ink cartridges 10" when there is no need to distinguish the colors) can be installed in the cartridge installation part 4 by inserting them from the front face of the apparatus body 1 toward the backside thereof. At the side of the front face of the cartridge installation part 4, a front cover (cartridge cover), 6 that is opened when the ink cartridge 10 is attached or detached is provided so that it can be opened or closed. Also, the ink cartridges 10*k*, 10*c*, 10*m*, and 10*y* have configurations such that they are installed in standing positions and juxtaposed side by side.

This front cover 6 is entirely made of a transparent or semi-transparent material such that the plural ink cartridges 10*k*, 10*c*, 10*m*, and 10*y* installed in the cartridge installation part 4 can be viewed from the outside thereof on the condition of closing the front cover 6. Additionally, the cover can be configured such that a part of the cover is made of a transparent or semi-transparent material whereby the ink cartridges 10*k*, 10*c*, 10*m*, and 10*y* can be viewed from the outside.

Also, remaining quantity indication parts for the respective colors 11*k*, 11*c*, 11*m*, and 11*y* (referred to as "remaining quantity indication parts 11" when there is no need to distinguish the colors) for indicating that the remaining quantities of inks in the ink cartridges for respective colors 10*k*, 10*c*, 10*m* and 10*y* are in the condition of near-end or end are arranged on the operation/indication part 5 at installation positions corresponding to the installation positions (arrangement positions) of the ink cartridges for respective colors 10*k*, 10*c*, 10*m*, and 10*y*. Further, the operation/installation part 5 is also provided with a power supply button 12, a paper sending/printing restart button 13, and a cancel button 14.

Figure 2:
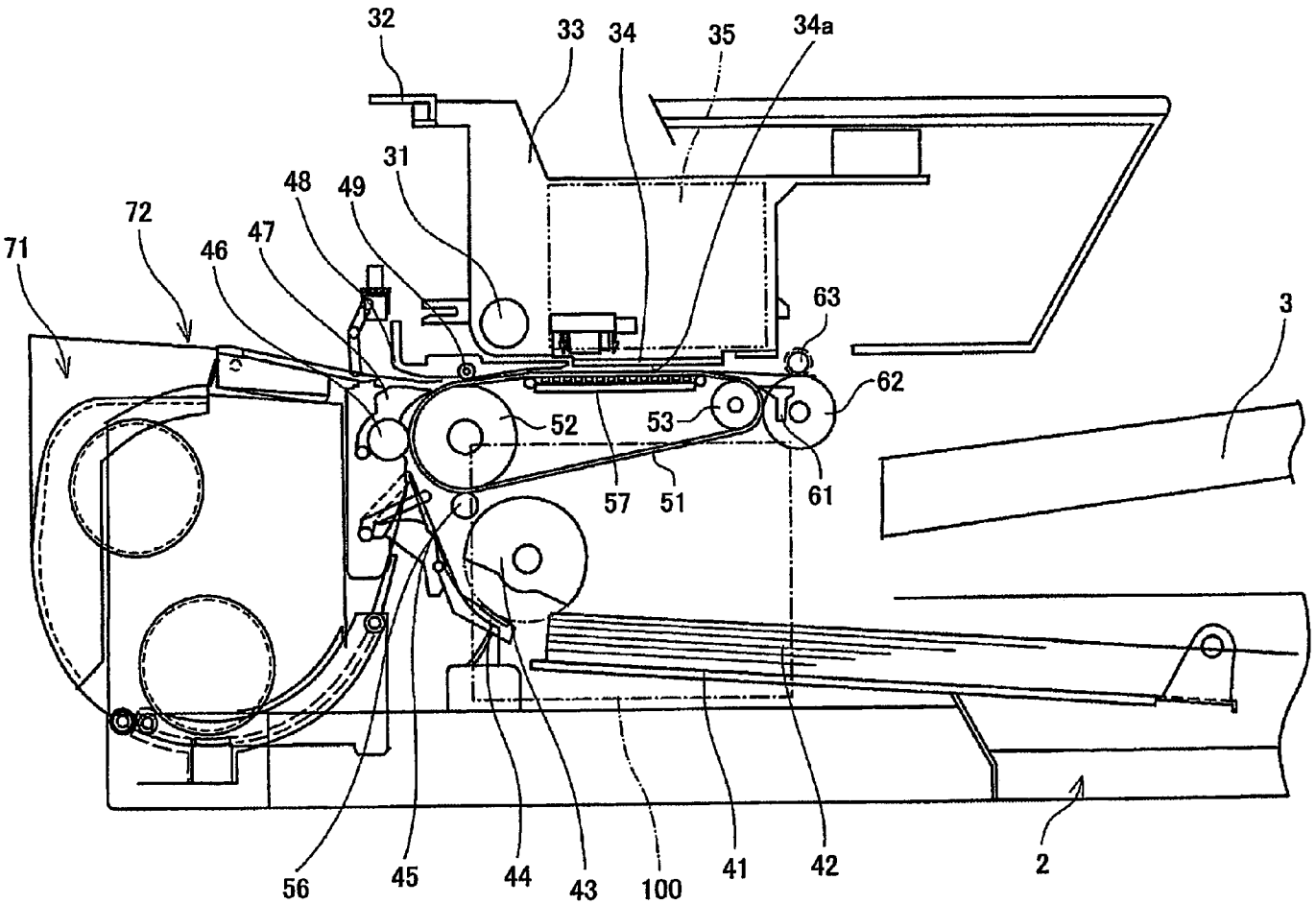
FIG. 2 is a schematic diagram illustrating the structure of a mechanical part of the image forming apparatus.
Figure 3:
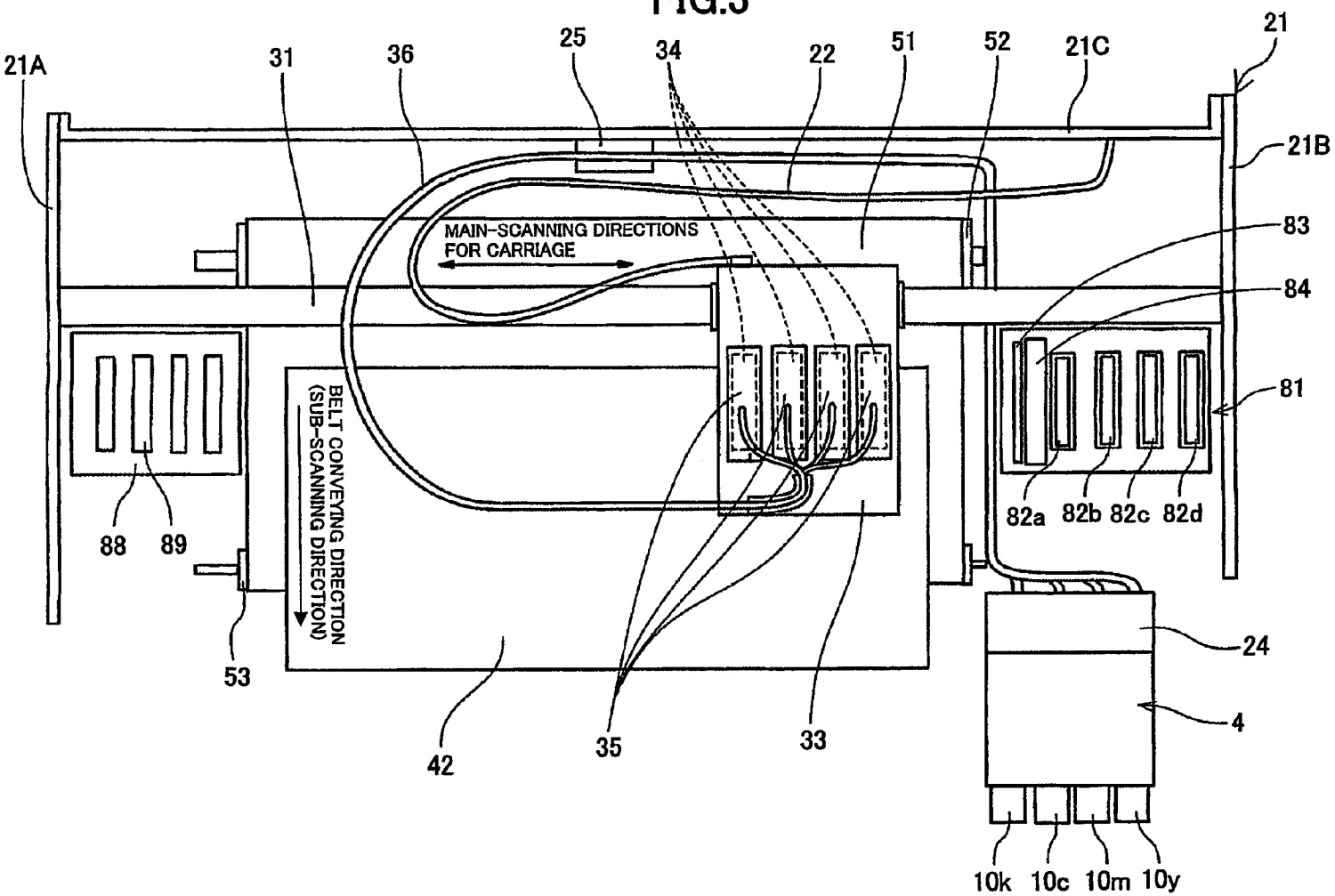
FIG. 3 is a plan view of an essential part of the mechanical part.

Next, a mechanical part of the image forming apparatus is described with referring to FIG. 2 and FIG. 3. Herein, FIG. 2 is a schematic diagram illustrating the whole structure of the mechanical part and FIG. 3 is a plan view of a specific part of the mechanical part.

A carriage 33 is held slidably in main-scanning directions by a guide rod 31 as a guide member extending to left and right side plates 21A, 21B constituting frame 21 and a stay 32, and is moved for scanning in the directions of an arrow (carriage main-scanning directions) by a main scanning motor that is not shown in the figures.

The carriage 33 is provided with a recording head 34 including four liquid-drop ejection heads for ejecting ink drops with respective colors, such as yellow (Y), cyan (C), magenta (M), and black (Bk), as described above, so that a nozzle face 34*a* has plural ink ejection ports (nozzles) that are arranged in directions crossing the main-scanning directions, and the direction of ink ejection is downward.

As an ink jet head constituting the recording head 34, an ink jet head with a pressure generation device for generating pressure for ejecting a liquid drop such as a piezoelectric actuator using a piezoelectric element, a thermal actuator that utilizes phase change of liquid by film boiling thereof using an electro-thermal conversion element such as an exothermic resistor, a shape memory alloy actuator using metal phase change dependent on temperature change, and an electrostatic actuator utilizing an electrostatic force, can be used.

A driver IC is installed in the recording head 34 which IC is connected to a control part that is not shown in the figures through a harness (flexible print cable) 22.

Also, the carriage 33 is provided with sub-tanks for respective colors 35 for supplying inks with respective colors to the recording head 34. To the sub-tanks for respective colors 35, inks with respective colors are supplied from ink cartridges for respective colors 10 installed in the cartridge installation part 4 as described above, through ink supply tubes for respective colors 36. Additionally, the cartridge 4 is provided with a supply pump unit 24 for sending liquid of ink in the ink cartridges 10 and the ink supply tubes 36 are held by an engaging member 25 on a back plate 21C constituting the frame 21 in the course of extending the tubes.

On the other hand, in a paper feed part for feeding papers 42 stacked on a paper stacking part (pressurizing plate) 41 of the paper feed tray 2, a crescentic control roller (paper feed control roller) 43 for separating papers 42 from the paper stacking part 41 and feeding them piece by piece, and a separation pad 44 opposing the paper feed control roller 43 and made of a material with a large coefficient of friction are provided, wherein the separation pad 44 is pushed to the side of the paper feed control roller 43.

Then, a guide member 45 for guiding a paper 42, a counter-roller 46, a conveyance guide member 47, and a pressurizing member 48 having a tip pressurizing control roller 49 are provided, and further a conveyer belt 51 as a conveying device for electrostatically holding the fed and sent paper 42 and conveying it through the location opposing the recording head 34 is provided, in order to send the papers 42 fed from the paper feed part to the downside of the recording head 34.

The conveyer belt 51 has no end and is configured such that it is extended around both a conveyance roller 52 and a tension roller 53 and revolves along a belt conveyance direction (sub-scanning direction). The conveyance belt 51 is charged (or provided with a charge) by a charging roller 56 while it is revolving.

Figure 4:
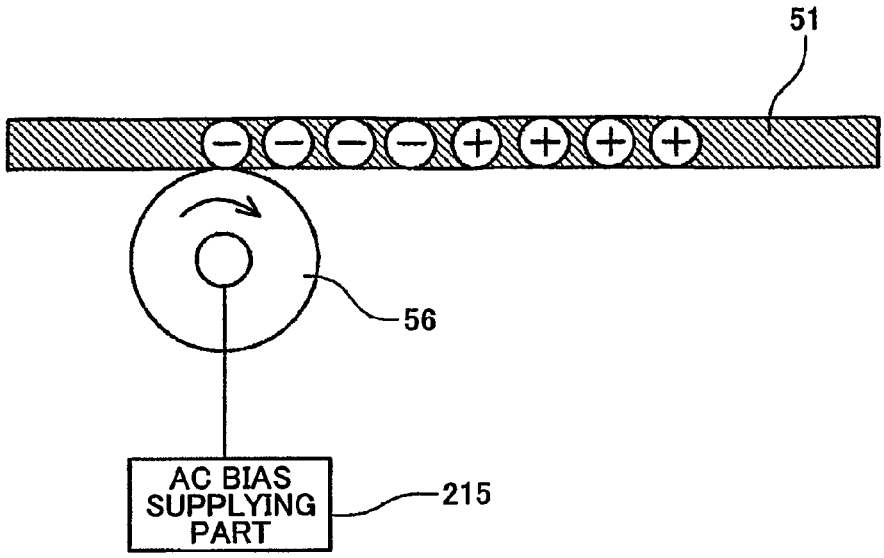
FIG. 4 is a schematic diagram illustrating one example of the structure of a conveyer belt of the image forming apparatus.
Figure 5:
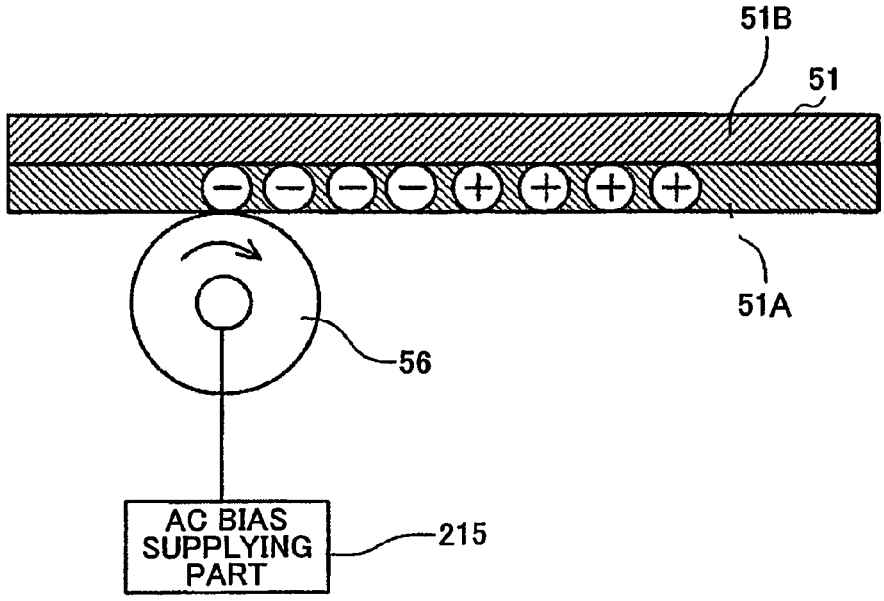
FIG. 5 is a schematic diagram illustrating another example of the structure of a conveyer belt of the image forming apparatus.

The conveyer belt 51 may have a mono-layer structure as shown in FIG. 4 or may have a plural-layer (or bi- or multi-layer) structure as shown in FIG. 5. In the case of the conveyer belt 51 with a mono-layer structure, since it contacts the paper 42 or the charging roller 56, the layer is entirely formed from an insulating material. Also, in the case of the conveyer belt 51 with a plural-layer structure, preferably, the side of it which contacts the paper 42 or the charging roller 56 is formed as an insulating layer 51A and the side of it which does not contact the paper 42 nor the charging roller 56 is formed as an electrically conductive layer 51B.

As an insulating material for forming the conveyance belt 51 with a mono-layer structure and an insulting material for forming the insulating layer 51A of the conveyance belt 51 with a plural layer structure, a material being a resin or an elastomer and containing no electrical conductivity control agent, such as PET, PEI, PVDF, PC, ETFE, and PTFE, is preferable and the volume resistivity of the material is $10^{12}$ Ωcm or higher, preferably $10^{15}$ Ωcm or higher. Also, as a material for forming the electrically conductive layer 51B of the conveyance belt 51 with a plural-layer structure, the volume resistivity of it is preferably $10^5$ through $10^7$ Ωcm, achieved by the material containing carbon in the resin or elastomer.

The charging roller 56 contacts the insulating layer 51A composing the surface layer of the conveyance belt 51 (in the case of the belt with a plural-layer structure) and is arranged to rotate in accordance with the rotation of the conveyance belt 51, where both ends of the axis of the roller are pressurized. The charging roller 56 is formed of an electrically conductive material with a volume resistivity of $10^6$ through $10^9$ Ω/□. To the charging roller 56, for example, 2 kV of AC bias (high voltage) is applied from an AC bias supplying part (high voltage power supply) 315, as described below. The AC bias may be a sine wave or a triangle wave, but preferably is a square wave.

Also, a guide member 57 is arranged at the backside of the conveyance belt 51 such that it corresponds to an image area for printing by the recording head 34. The guide member 57 maintains the highly precise planarity of the conveyance belt 51 by projecting the top surface of the guide member 57 at the side of the recording head 35 from the tangent line between the two rollers (the conveyance roller 52 and the tension roller 53) supporting the conveyance belt 51.

The conveyance belt 51 revolves along the belt conveyance direction in FIG. 3 due to the rotation of the conveyance roller 52, which is driven by a sub-scanning motor that is not shown in the figures via a driving belt.

Furthermore, as a paper ejection part for ejecting the paper 42 on which recording is made by the recording head 34, a separation claw 61 for separating the paper 42 from the conveyance belt 51, the paper ejection roller 62, and the paper ejection control roller 63 are provided, and the paper ejection tray 3 is provided below the paper ejection roller 62. Herein, the height of the paper ejection tray 3 from a position between the paper ejection roller 62 and the paper ejection roller 63 is appropriately large in order to increase the quantity of papers that can be stacked on the paper ejection tray 3.

Also, a double-side unit 71 is attached detachably at the backside of the apparatus body 1. The double-side unit 71 receives and reverses the paper 42 that is sent to the unit by revolving in a direction opposing the revolving direction of the conveyance unit 51, and feeds the reversed paper between the counter-roller 46 and the conveyance belt 51 again. Also, the top face of the double-side unit 71 is made be a manual feed tray 72.

Further, a maintenance or restoring mechanism 81 for maintaining or restoring the condition of a nozzle of the recording head 34 is arranged in a non-character printing area at one side of the directions for scanning of the carriage 33 as shown in FIG. 3.

For the maintenance or restoring mechanism 81, respective cap members (referred to as "caps" below) 82*a* through 82*d* (referred to as "caps 82" when they are not distinguished) for capping respective nozzle faces of the recording head 34, a wiper blade 83 as a blade member for wiping a nozzle face, and a blank ejection receiver 84 for receiving a liquid drop at the time of performing blank ejection for ejecting a liquid drop that does not contribute to recording so as to eject thickened recording liquids, are provided. Herein, the cap 82*a* is for aspiration and moisture retention and the other caps 82*b* through 82*d* are for moisture retention.

Then, the disposal liquid of recording liquid produced by a maintenance or restoring operation of the maintenance or restoring mechanism 81, ink ejected into the cap 82, ink removed by a wiper cleaner 85 attached to the wiper blade 83, and ink blank-ejected to the blank ejection receiver 94 are ejected and stored in a disposal liquid tank 100 being a container for storing the disposal liquid shown by a virtual line in FIG. 2.

Also, as shown in FIG. 3, a blank ejection receiver 88, for receiving a liquid drop when the blank ejection for ejecting a liquid drop that does not contribute to recording is performed in order to eject thickened recording liquid during the recording, is arranged on a non-character printing area at the other side of the scanning directions of the carriage 33, and the blank ejection receiver 88 is provided with apertures 89 along the directions of the line of the nozzles of the recording head 34.

Figure 6:
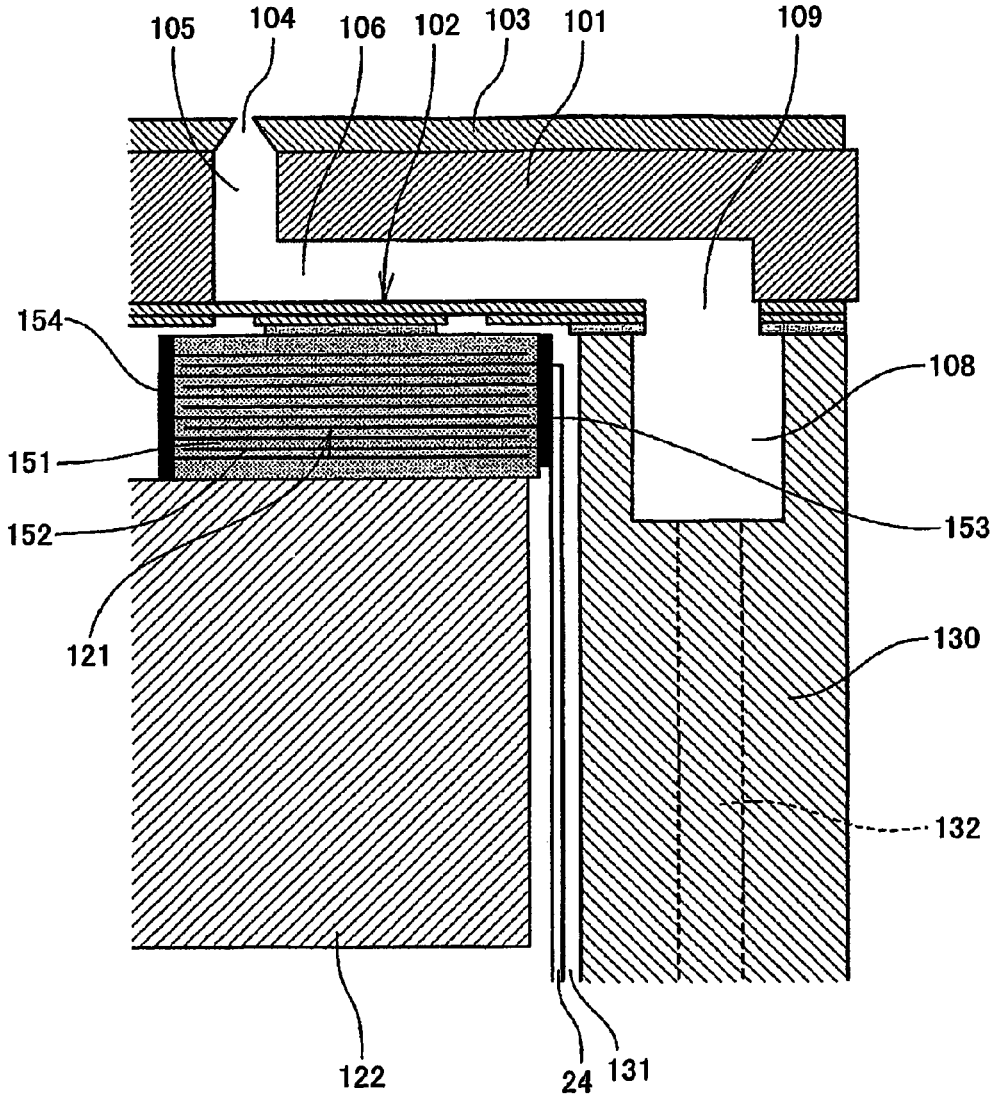
FIG. 6 is a cross-sectional view of an example of a liquid drop ejection head constituting a recording head of the image forming apparatus along the longitudinal directions of a liquid chamber.
Figure 7:
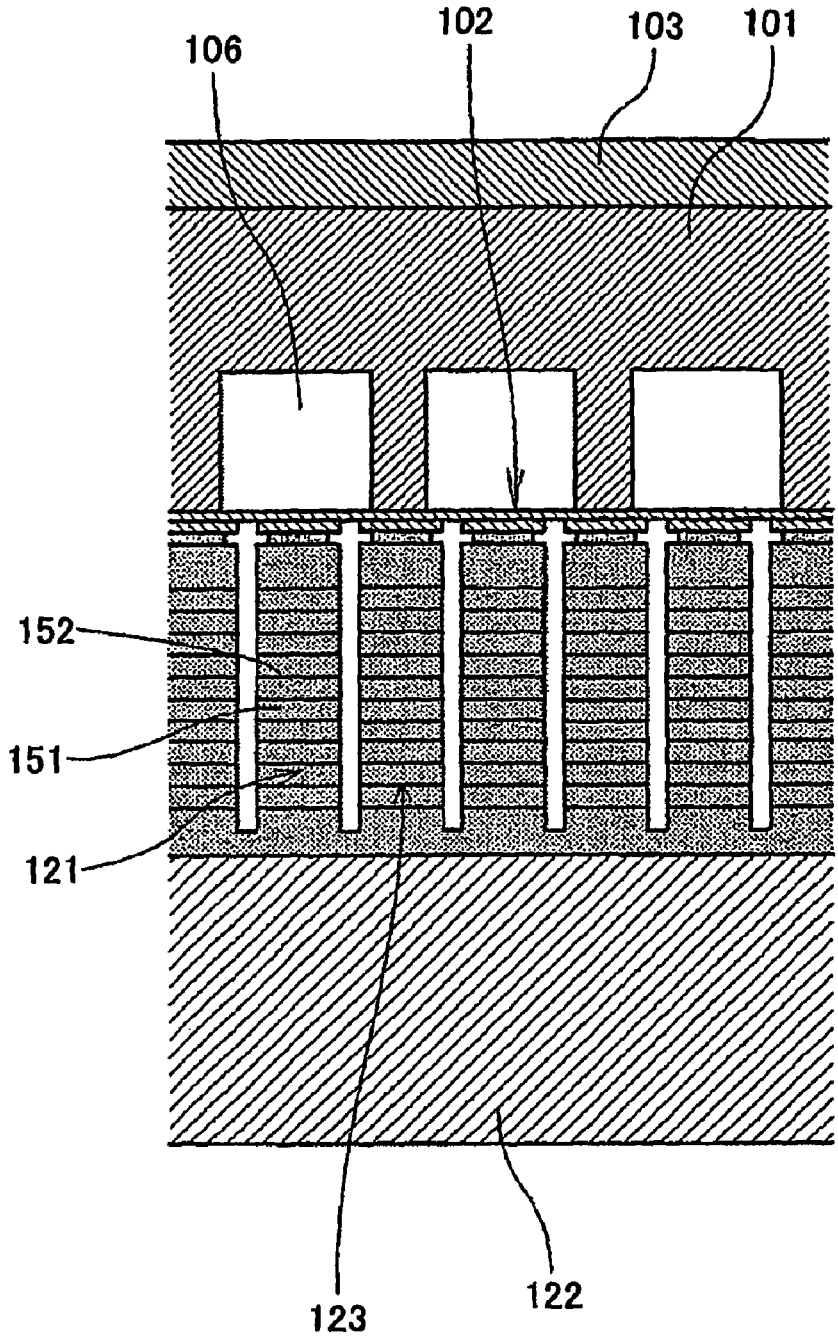
FIG. 7 is a cross-sectional view of the head along the lateral directions of a liquid chamber.

Next, one example of a liquid drop ejection head constituting a recording head of the image forming apparatus is described by referring to FIG. 6 and FIG. 7. Additionally, FIG. 6 is a cross-sectional view of the head along the longitudinal directions of a liquid chamber and FIG. 7 is a cross-sectional view of the head along the lateral directions of the liquid chamber (the juxtaposition directions of the nozzles).

The liquid drop ejection head is provided by jointing and stacking a flow channel plate 101 formed by anisotropically etching a single crystal silicon substrate, a vibration plate 102 formed by, for example, nickel-electroforming, which is jointed to the bottom face of the flow channel plate 101, and a nozzle plate 103 jointed to the top face of the flow channel plate 101, thereby forming a nozzle communicating channel 105 communicating with a nozzle 104 for ejecting a liquid drop (ink drop), a liquid chamber 106, and an ink supply opening 109 communicating with a common liquid chamber 108 for supplying ink into the liquid chamber 106.

Also, two lines of stacked piezoelectric elements 121 (only one line is shown in the figures) as electromechanical conversion elements being pressure generation devices (actuator devices) for pressurizing ink in the liquid chamber 106 by deforming the vibration plate 102, and a base substrate 122 for jointing and fixing the piezoelectric element 121 are provided. Additionally, a columnar support part 123 is provided between the piezoelectric elements 121. The columnar support part 123 is simultaneously formed with the piezoelectric elements 121 by separately processing the material for the piezoelectric elements; however, it is merely a columnar support since no driving voltage is applied to it.

Also, the piezoelectric elements 121 are connected to FPC cables 22 for connecting the elements to a driving circuit (driving IC) that is not shown in the figures.

Then, the peripheral portion of the vibration plate 102 is jointed to a frame member 130; concave portions which include a perforation portion 131 for accommodating an actuator unit composed of the piezoelectric elements 121 and the base substrate 122, the common liquid chamber 108, and an ink supply hole 132 for supplying ink from the exterior to the common liquid chamber 108 are formed on the frame member 130. The frame part 130 is formed by injection molding of, for example, a thermosetting resin such as an epoxy resin or polyphenylene sulphite.

Herein, the concave portions and a hole which become the nozzle communicating channel 105 and the liquid chamber 108 are formed in the flow channel plate 101, for example, by anisotropically etching a single crystal silicon substrate with a crystallographic plane direction of (101) with an alkaline etching liquid such as an aqueous solution of potassium hydroxide (KOH); however, the substrate is not limited to a single crystal silicon substrate but another substrate such as a stainless substrate and a photosensitive resin substrate can be used.

The vibration plate 102 is formed from a metallic plate of nickel and, for example, produced by means of an electroforming method (electrocasting method); another metal plate or a jointed plate of a metal plate and a resin plate can be also used. To the vibration plate 102, the piezoelectric elements 121 and the columnar support part 123 are jointed by an adhesive and further the frame part 130 is jointed by an adhesive.

For the nozzle plate 103, the nozzles 104 with a diameter of 10 through 30 μm are formed and corresponds to respective liquid chambers and the nozzle plate is connected to the flow channel 101 by an adhesive. The nozzle plate 103 is provided by forming a water-repellent layer as the top surface thereof on the surface of a nozzle forming part made of a metallic member through the intermediate of a required layer.

The piezoelectric elements 121 are a stacked-layer-type piezoelectric element (PZT herein) in which a piezoelectric material 151 and internal electrodes 152 are stacked alternately. The respective internal electrodes 152 alternately drawn to corresponding end surfaces of the piezoelectric element 121 are connected to a separate electrode 153 or the common electrode 154. Additionally, a configuration such that ink in the liquid chamber 106 is pressurized using the displacement of the piezoelectric element 121 along the direction of d33 as a piezoelectric direction is adopted in this embodiment, but a configuration such that ink in the liquid chamber 106 is pressurized along the direction of d31 as a piezoelectric direction can be also allowed. Also, a structure such that one column of a piezoelectric element 121 is provided on one substrate 122 can be allowed.

In the thus configured liquid drop ejection head, for example, the piezoelectric element 121 contracts and the vibration plate 102 moves down by lowering a voltage applied to the piezoelectric element 121 from a reference voltage so that the volume of the liquid chamber 106 expands and ink flows into the liquid chamber 106. Afterward, the piezoelectric element 102 is extended in the directions of layer stacking by raising the voltage applied to the piezoelectric element 121 and the vibration plate 102 is deformed toward the side of the nozzle 104 so as to reduce the volume of the liquid chamber 106. As a result, recording liquid in the liquid chamber 106 is pressurized and a drop of the recording liquid is ejected (or jetted) from the nozzle 104.

Then, the vibration plate 102 returns to the initial position thereof by setting the voltage applied to the piezoelectric element 121 back to the reference voltage and the liquid chamber 106 expands to cause a negative pressure therein. At this time, the recording liquid is supplied from the common liquid chamber 108 to the liquid chamber 106. Then, after the vibration of a meniscus surface of ink on the nozzle face is dampened and the surface is stabilized, the transfer to an operation for next ejection of a liquid drop is made.

Additionally, the method for driving this head is not limited to the example described above (pull-push ejection), and pull-ejection or push-ejection may be performed dependent on provided driving waves.

Figure 8:
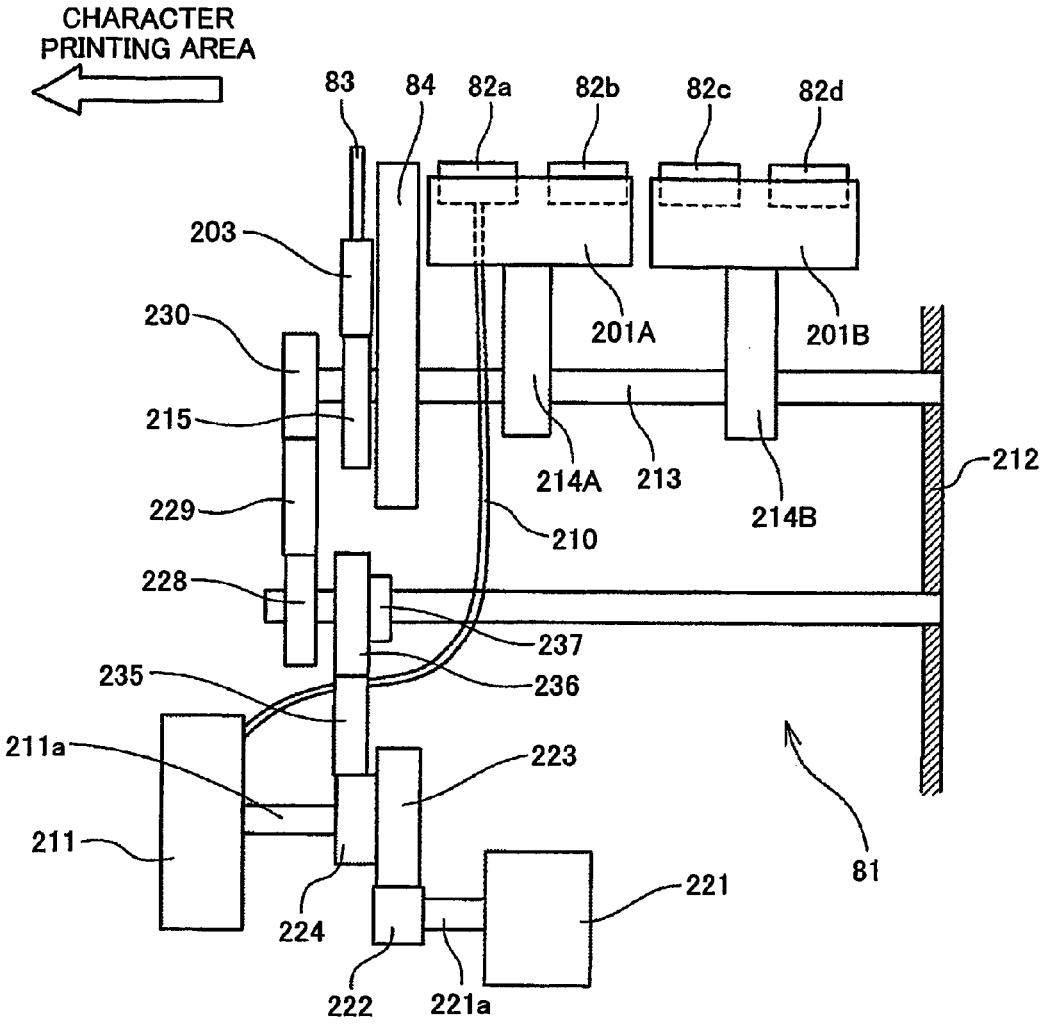
FIG. 8 is a schematic diagram of a maintenance or restoring mechanism of the image forming apparatus.

Next, the general configuration of the maintenance or restoring mechanism 81 is described with referring to FIG. 8. Additionally, the figure is a schematic diagram illustrating the maintenance or restoring mechanism in the condition that a part of the mechanism is developed.

For the maintenance or restoring mechanism 81, a cap holder 201A including a holding mechanism for holding an aspiration and moisture retention cap 82*a* and a moisture retention cap 82*b*, a cap holder 201B including a holding mechanism for holding the moisture retention cap 82*c* and the moisture retention cap 82*d*, a blade holder for holding a wiper blade 83 as a blade composed of an elastic body for cleaning (wiping) a nozzle face 34*a* of the recording head 34, and a blank ejection receiver 84 for performing blank ejection operation (pre-ejection operation) for ejecting a liquid drop that does not contribute to character printing from the recording head 34 are provided as described above.

Herein, the aspiration and moisture retention cap 82*a* at the closest side of the character printing area is connected to a tubing pump (aspiration pump) 21 as an aspiration device via a flexible tube 210. Therefore, when the maintenance or restoring operation for the recording head 34 is performed, the recording head 34 for performing the restoring operation is electively moved to a position at which the head can be capped by the cap 82*a*.

Also, a cam shaft 213 that is rotatably supported on a frame 212 is arranged below the cap holders 201A, 201B and the cam shaft 213 is provided with the cap cams 214A, 214B for lifting or lowering the cap holders 201A, 201B and a wiper cam 215 for lifting or lowering the blade holder 203.

Then, in order to drive the tubing pump 211 and rotate the cam shaft 213 due to the rotation of a motor 221, a pump gear 223 provided on a pump shaft 211*a* of the tubing pump 211 is engaged with a motor gear 222 provided on a motor shaft 211*a*, and further an intermediate gear 236 provided with a one-directional clutch 237 is engaged with an intermediate gear 224 united with the pump gear 223 via an intermediate gear 235. Then, a cam gear 230 fixed on the cam shaft 213 is engaged with an intermediate gear 228 that is co-axial with the intermediate gear 226 via an intermediate gear 229.

In the maintenance or restoring mechanism 81, the motor gear 222, the intermediate gear 224, the pump gear 223, and the intermediate gears 235, 236 are rotated by rotating the motor 221 in a normal direction and the tubing pump 211 operates by the rotation of the shaft 211*a* of the tubing pump 211, so as to aspirate the inside of the aspiration cap 82*a* (this operation is referred to as "cap inside aspiration" or "head aspiration"). The other gears 228, etc., do not rotate since their rotation is prevented due to the one-directional clutch 237, not engaging.

Also, since the one-directional clutch 237 is engaged by rotating the motor 221 in a reverse direction, the reverse rotation of the motor 221 is transmitted to the cam gear 230 through the motor gear 222, the pump gear 223, the intermediate gear 224, and the intermediate gears 235, 236, 228, and 229, so that the cam shaft 213 rotates. Then, the tubing pump 211 has a structure such that it does not operate during reverse rotation of the pump shaft 211*a*. Each of the cap cams 214A, 214B and the wiper cam 215 is lifted or lowered at a predetermined timing by the rotation of the cam shaft 213.

Additionally, when the nozzle face 34*a* of the recording head 34 is cleaned, the nozzle face 34*a* is wiped by moving the recording head 34 relative to the wiper blade 83 on the condition that the wiper blade 82 is lifted.

In the thus configured image forming apparatus, the papers 42 from the paper feed tray 2 are separated and fed piece by piece. Then, the paper 42 generally fed in the vertical and upward direction is guided by the guide 45, sandwiched between the conveyer belt 51 and the counter-roller 46, and conveyed. Further, the tip of the paper is guided by a conveyer guide 47 and the paper is pressured to the conveyer belt 51 by the tip pressurizing control roller 49, so that the conveying direction for the paper is changed by approximately 90 degrees.

At this time, a plus output and a minus output are applied alternately and repeatedly, that is, an alternating voltage is applied from an AC bias supplying part 215 of a control part described below to the charging roller 56. Then, an alternating charging voltage pattern, that is, a charging pattern such that a plus strip and a minus strip are alternately provided at a predetermined width along the sub-scanning direction being the rotational direction of the conveyer belt, is formed on the conveyer belt 51. As the paper 42 is fed and sent on the conveyer belt 51 which is alternately charged to plus or minus, the paper 42 is held on the conveyer belt 51 and the paper 42 is conveyed in the sub-scanning direction by the rotational movement of the conveyer belt 51.

Herein, ink drops are ejected on the paper 42 at a stop by driving the recording head 34 according to an image signal while the carriage 33 is moved, so as to record one line, and after the paper 42 is conveyed a predetermined distance, recording of a next line is performed. Recording operations are finished by receiving a recording completion signal or a signal indicating that the rear end of the paper 42 reaches a recording area, and the paper 42 is ejected to the paper ejection tray 3.

Also, the carriage 33 is moved to the side of the maintenance or restoring mechanism 81 while waiting for the character printing (recording) and the recording head 34 is capped with the cap 82 so as to keep the nozzle in the wetted condition whereby the failure of ejection caused by drying of ink is prevented. Also, the recording liquid is aspirated through the nozzle by an aspiration pump that is not shown in the figure (referred to as "nozzle aspiration" or "head aspiration"), on the condition that the recording head 34 is capped with the cap 82, and a restoring operation for ejecting the thickened recording liquid or air bubble is performed. Also, a blank ejection operation for ejecting ink that does not relate to recording is performed before the start of the recording or during the recording. Thereby, the stable ejection performance of the recording head 34 is maintained. Additionally, as described below, an operation for cleaning the nozzle face 34*a* of the recording head 34 by the wiper blade 83 is performed based on a tolerance threshold value of contamination on the nozzle face and a counted value of the number of ejected ink drops (the number of ejected liquid drops) by the image forming apparatus.

Next, one example of ink used for the image forming apparatus (or recording liquid, referred to as the "present ink" below) is described.

The present ink is composed of the following (1) through (10). As a coloring agent for character printing, a pigment and a solvent for decomposing or dispersing the agent are used as an essential components, and further, a wetting agent, a surface active agent, an emulsion, a preservative, and a pH controlling agent may be used as additives. A wetting agent 1 and a wetting agent 2 are mixed for utilizing the characteristics of the respective wettabilities and for adjusting the viscosity of the ink easily.

(1) a pigment (a self-dispersive pigment) 6 wt % or more
(2) a wetting agent 1
(3) a wetting agent 2
(4) an organic solvent
(5) an anionic or nonionic surface active agent
(6) a polyol or glycol ether with a carbon number equal to or greater than 8
(7) an emulsion
(8) a preservative
(9) a pH controlling agent
(10) purified water The aforementioned respective components of the ink are described more specifically.

In regard to (1) a pigment, the kind thereof is not particularly limited and an inorganic pigment or an organic pigment can be used. As an inorganic pigment, a carbon black produced by a publicly known method such as a contact method, a furnace method, and a thermal method in addition to titanium oxide and iron oxide can be used. Also, as an organic pigment, an azo pigment (which can include an azo lake, an insoluble azo pigment, a condensed azo pigment and a chelate azo pigment), a polycyclic pigment (for example, a phthalocyanine pigment, a perylene pigment, a perynone pigment, an anthraquinone pigment, a quinacridone pigment, a dioxazine pigment, a thioindigo pigment, an isoindolinone pigment, and a quinofranone pigment), a dye chelate (for example, a basic dye-type chelate and an acidic dye-type chelate), a nitro pigment, a nitroso pigment, and aniline black can be used.

Among these pigments, a pigment having an affinity for water is preferably used. The particle size of a pigment is preferably 0.05 μm through 10 μm, more preferably 1 μm or less, and most preferably 0.16 μm or less.

The loading of a pigment as the coloring agent in the ink is, preferably, approximately 6 through 20 wt %, and more preferably, approximately 8 through 12 wt %.

As specific examples of a pigment that is preferably used in the present ink, the following pigments are provided. For black color, carbon blacks (C.I. pigment black 7) such as furnace black, lamp black, acetylene black, and channel black, metals such as copper, iron (C.I. pigment black 11), and titanium oxide, and organic pigments such as aniline black (C.I. pigment black 1) are provided.

For colors, C.I. pigment yellows 1 (fast yellow G), 3, 12 (disazo yellow AAA), 13, 14, 17, 24, 34, 35, 37, 42 (yellow oxide), 53, 55, 81, 83 (disazo yellow HR), 95, 97, 98, 100, 101, 104, 408, 109, 110, 117, 120, 138, and 153, C.I. pigment oranges 5, 13, 16, 17, 36, 43, and 51, pigment red 1, 2, 3, 5, 17, 22 (brilliant fast scarlet), 23, 31, 38, 48:2 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 101 (red iron oxide), 104, 105, 106, 108 (cadmium red), 112, 114, 122 (quinacridone magenta), 123, 146, 149, 166, 168, 170, 172, 177, 178, 179, 185, 190, 193, 209, and 219, C.I. pigment violets 1 (rhodamine lake), 3, 5:1, 16, 19, 23, and 38, C.I. pigment blues 1, 2, 15 (phthalocyanine blue R), 15:1, 15:2, 15:3 (phthalocyanine blue E), 16, 17:1, 56, 60, and 63, and C.I. pigment greens 1, 4, 7, 8, 10, 17, 18, and 36 are provided.

Besides, a graft pigment obtained by treating the surface of a pigment (for example, carbon) with a resin so as to be dispersible in water and a processed pigment obtained by providing the surface of a pigment (for example, carbon) with a functional group such as a sulfone group and a carboxyl group so as to be dispersible in water can be used.

Also, a microcapsule containing a pigment so as to make the pigment be dispersible in water may be used.

According to a preferred aspect of the present ink, for a pigment for black ink, it is preferable to add a pigment-dispersed liquid obtained by dispersing the pigment with a dispersing agent in an aqueous medium into ink. As a preferred dispersing agent, a publicly-known dispersing liquid used for preparing the conventional and publicly-known pigment-dispersed liquid can be used.

As the dispersing liquid, for example, the following substances can be provided. Poly(acrylic acid), poly(methacrylic acid), acrylic acid-acrylonitrile copolymer, vinyl acetate-acrylate copolymers, acrylic acid-alkyl acrylate copolymers, styrene-acrylic acid copolymer, styrene-methacrylic acid copolymer, styrene-acrylic acid-alkyl acrylate copolymers, styrene-methacrylic acid-alkyl acrylate copolymers, styrene-α-methylstyrene-acrylic acid copolymer, a styrene-α-methylstyrene-acrylic acid copolymer-an acrylic acid-alkyl acrylate copolymer, styrene-maleic acid copolymer, vinylnaphthalene-maleic acid copolymer, vinyl acetate-ethylene copolymer, vinyl acetate-vinyl ester of a fatty acid-ethylene copolymers, vinyl acetate-maleate copolymers, vinyl acetate-crotonic acid copolymer, and vinyl acetate-acrylic acid copolymer are provided.

According to the preferred aspect of the present ink, the weight-average molecular weights of the (co)polymers are preferably 3,000 through 50,000, more preferably, 5,000 through 30,000, and most preferably 7,000 through 15,000. In regard to the loading of the additive, the additive may be appropriately added in a range of dispersing a pigment stably and having no loss of another effect of the present invention. The range for the additive is preferably 1:0.06 through 1:3, more preferably 1:0.125 through 1:3.

The content of the pigment used as a coloring agent in the total weight of the ink for recording is 6 wt % through 20 wt % and the pigment is a particle with a particle size of 0.05 μm through 0.16 μm and is dispersed with a dispersing agent in water. Also, the dispersing agent is a polymeric dispersing agent having a molecular weight of 5,000 through 100,000. If a pyrrolidone derivative, particularly 2-pyrrolidone, is used as at least one kind of water-soluble organic solvent, image quality is improved.

In regard to (1) through (2) wetting agents 1 and 2 and the water-soluble organic solvent, in the case of the present ink, water is used as a liquid medium in the ink, but for example, the following water-soluble organic solvents are used for the purposes of giving the ink a desired physical property, preventing the ink from drying, and improving the dissolution stability for the ink. These plural water-soluble organic solvents may be mixed for use.

Specific examples of the wetting agents and the water-soluble organic solvent are provided, for example, as follows. That is, polyhydric alcohols such as ethylene glycol, diethylene glycol, triethylene glycol, propylene glycol, dipropylene glycol, tripropylene glycol, tetraethylene glycol, hexylene glycol, polyethylene glycol, polypropylene glycol, 1,5-pentanediol, 1,6-hexanediol, glycerol, 1,2,6-hexanetriol, 1,2,4-butanetriol, 1,2,3-butanetriol, and petriols, polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether, polyhydric alcohol aryl ethers such as ethylene glycol monophenyl ether and ethylene glycol monobenzyl ether, nitrogen-containing heterocyclic compounds such as 2-pyrrolidone, N-methyl-2-pyrrolidone, N-hydroxyethyl-2-pyrrolidone, 1,3-dimethylimidazolidinone, ε-caprolactam, and γ-butyrolactone, amides such as formamide, N-methylformamide, and N,N-dimethylformamide, amines such as monoethanolamine, diethanolamine, triethanolamine, monoethylamine, diethylamine, and triethylamine, sulfur-containing compounds such as dimethyl sulfoxide, sulfolane, and thiodietanol, propylene carbonate, and ethylene carbonate are provided.

Among these organic solvents, particularly, diethylene glycol, thiodiethanol, polyethylene glycols 200 through 600, triethylene glycol, glycerol, 1,2,6-hexanetriol, 1,2,4-butanediol, petriols, 1,5-pentanediol, 2-pyrrolidone, and N-methyl-2-pyrrolidone are preferable. These organic solvents can provide excellent effects to the solubility and the prevention of the failure of ejection property caused by evaporation of water.

As another wetting agent, it is preferable to contain a sugar. As examples of sugars, monosaccharides, disaccharides, oligosaccharides (that can include trisaccharides and tetrasaccharides), and polysaccharides are provided, and glucose, mannose, fructose, ribose, xylose, arabinose, galactose, maltose, cellobiose, lactose, sucrose, trehalose, and maltotriose are provided. Herein, polysaccharides mean generalized sugars and include substances that are widely existing in the natural world, such as α-cyclodextrin and cellulose.

Also, as derivatives from these sugars, reduced sugars (for example, sugar alcohols (represented by a general formula $HOCH_2(CHOH)_nCH_2OH$, wherein n represents an integer of 2 through 5)), oxidized sugars (for example, aldonic acid and uronic acid), amino acids, and thio acids from the aforementioned sugars are provided. Particularly, sugar alcohols are preferable and as the specific examples thereof, maltitol and sorbitol are provided.

The content of the sugar is appropriately in a range of 0.1 wt % through 40 wt %, preferably 0.5 through 30 wt % of the ink composition.

Also, (5) a surface active agent is not particularly limited, and as anionic surface active agents, for example, polyoxyethylene alkyl ether acetate salts, dodecylbenzenesulfonate salts, laurate salts and polyoxyethylene alkyl ether sulfate salts are provided. As nonionic surface active agents, for example, polyoxyethylene alkyl ethers, polyoxyethylene alkyl esters, esters from polyoxyethylene sorbitan fatty acid, polyoxyethylene alkylphenyl ethers, polyoxyethylenealkylamines, and polyoxyethylenealkylamides are provided. The surface active agent can be used singularly or the two or more kinds of the surface active agents can be mixed and used.

The surface tension of the present ink is an indicator of the permeability of the ink into a paper and, particularly, it is the dynamic surface tension of the ink over short time period of 1 second or less from the surface formation, which is different from static surface tension measured within a time period of saturation. As the measurement method for the surface tension, any of methods that can measure the dynamic surface tension within 1 second or less, such as the conventional and publicly known method disclosed in Japanese Laid-Open Patent Application No. 63-31237 can be used; however, the measurement was performed using a Wilhelmy lifting-plate-type surface tension meter herein. The value of the surface tension is preferably 40 $mJ/m^2$ or less, more preferably 35 $mJ/cm^2$ or less, whereby excellent fixation and drying properties can be obtained.

In regard to (6) polyols or glycol ethers which have the carbon number of 8 or greater, it was found that the wettability of the ink to a thermal element is improved and ejection stability and frequency stability can be improved even on the small loadings, by adding at least one of partially water-soluble polyols and glycol ethers having solubility equal to or greater than 0.1 and less than 4.5 wt % in water at 25° C. by 0.1 through 10.0 wt % of the total weight of the ink for recording.

(a) 2-ethyl-1,3-hexanediol solubility: 4.2% (20° C.)

(b) 2,2,4-trimethyl-1,3-pentanediol solubility: 2.0% (25° C.)

A penetrating agent having solubility equal to or greater than 0.1 and less than 4.5 wt % in water at 25° C. has an advantage of having considerably high permeability instead of low solubility. Therefore, ink with considerably high permeability can be manufactured by the combination of the penetrating agent having a solubility equal to or greater than 0.1 and less than 4.5 wt % in water at 25° C. and another solvent or another surface active agent.

In regard to (7), a resin emulsion is preferably added to the present ink. The resin emulsion means an emulsion containing water as a continuous phase and a resin component as described below as a dispersed phase. As the resin component of the dispersion phase, acrylic resins, vinyl acetate resin, styrene-butadiene resin, vinyl chloride resin acryl-styrene resin, butadiene resin, and styrene resin are provided.

According to the preferred aspect of the present ink, the resin is preferably a polymer having both a hydrophilic portion and a hydrophobic portion. Also, the particle size of the resin component is not limited as long as the component forms an emulsion, but is preferably approximately 150 nm or less, more preferably approximately 5 through 100 nm.

The resin emulsion can be obtained by mixing resin particles with water and, in some cases, a surface active agent. For example, an emulsion of acrylic resin or styrene-acryl resin can be obtained by mixing a (meth)acrylate ester, or styrene and a (meth)acrylate ester, and, in some cases, a surface active agent with water. Commonly, the mixing ratio of the resin component to the surface active agent is, preferably, approximately 10:5 through 5:1. If the loadings of the surface active agent are less than the range described above, it is difficult to form an emulsion. If the loadings of the surface active agent are greater than the range described above, the water resisting property or permeability of the ink unfavorably tends to be lowered or deteriorated.

The ratio of water to the resin as a dispersed phase of the emulsion is appropriately in a range of 60 through 400, preferably 100 through 200, parts by weight of water to 100 parts by weight of the resin.

As commercially available resin emulsions, Microgel E-1002 and Microgel E-5002 (styrene-acryl resin emulsion, produced by Nippon Paint Co., Ltd.), Boncoat 4001 (acrylic resin emulsion, produced by Dainippon Ink & Chemicals, Inc.), Boncoat 5454 (styrene-acryl resin emulsion, produced by Dainippon Ink & Chemicals, Inc.), SAE-1014 (styrene-acryl resin emulsion, produced by Nippon Zeon Co., Ltd.), and Saibinol SK-200 (acrylic resin emulsion, produced by Saiden Chemical Industry Co., Ltd.) are provided.

The present ink preferably contains the resin emulsion such that the content of the resin component is 0.1 through 40 wt % of the ink, more preferable in a range of 1 through 25 wt %.

The resin emulsion has a thickening or coagulating property and effects of suppressing the penetration of the coloring component, thereby further facilitating the fixation to a recording-medium. Also, it has an effect of forming a coating on a recording-medium so as to enhance the abrasion resistance of a printed object, depending on the kind of resin emulsion.

In regard to (8) through (10), a conventionally known additive other than the coloring agent, solvent, and surface active agent described above can be added into the present ink.

For example, as a preservative or mildewproofing agent, sodium dehydroacetate, sodium sorbate, sodium 2-pyridinethiol-1-oxide, sodium benzoate, and sodium pentachlorophenolate can be used.

As a pH adjusting agent, any substance can be used as long as the pH of the ink can be adjusted to 7 or greater without adversely affecting the formulated ink. As the examples of the pH adjusting agent, amines such as diethanolamine and triethanolamine, alkali metal hydroxides such as lithium hydroxide, sodium hydroxide, and potassium hydroxide, ammonium hydroxide, quaternary ammonium hydroxides, quaternary phosphonium hydroxides, and alkali metal carbonate such as lithium carbonate, sodium carbonate, and potassium carbonate are provided.

As a chelating reagent, for example, sodium ethylenediaminetetraacetate, sodium nitrilotriacetate, sodium hydroxyethylethylenediaminetriacetate, sodium diethylenetriaminepentaacetate, and sodium uramildiacetate are provided.

As a corrosion inhibitor, for example, acidic sulfite salts, sodium thiosulfate, antimony thioglycollate, diisopropylammonium nitrite, pentaerythritol tetranitrate, and dicyclohexylammonium nitrite are provided.

Figure 9:
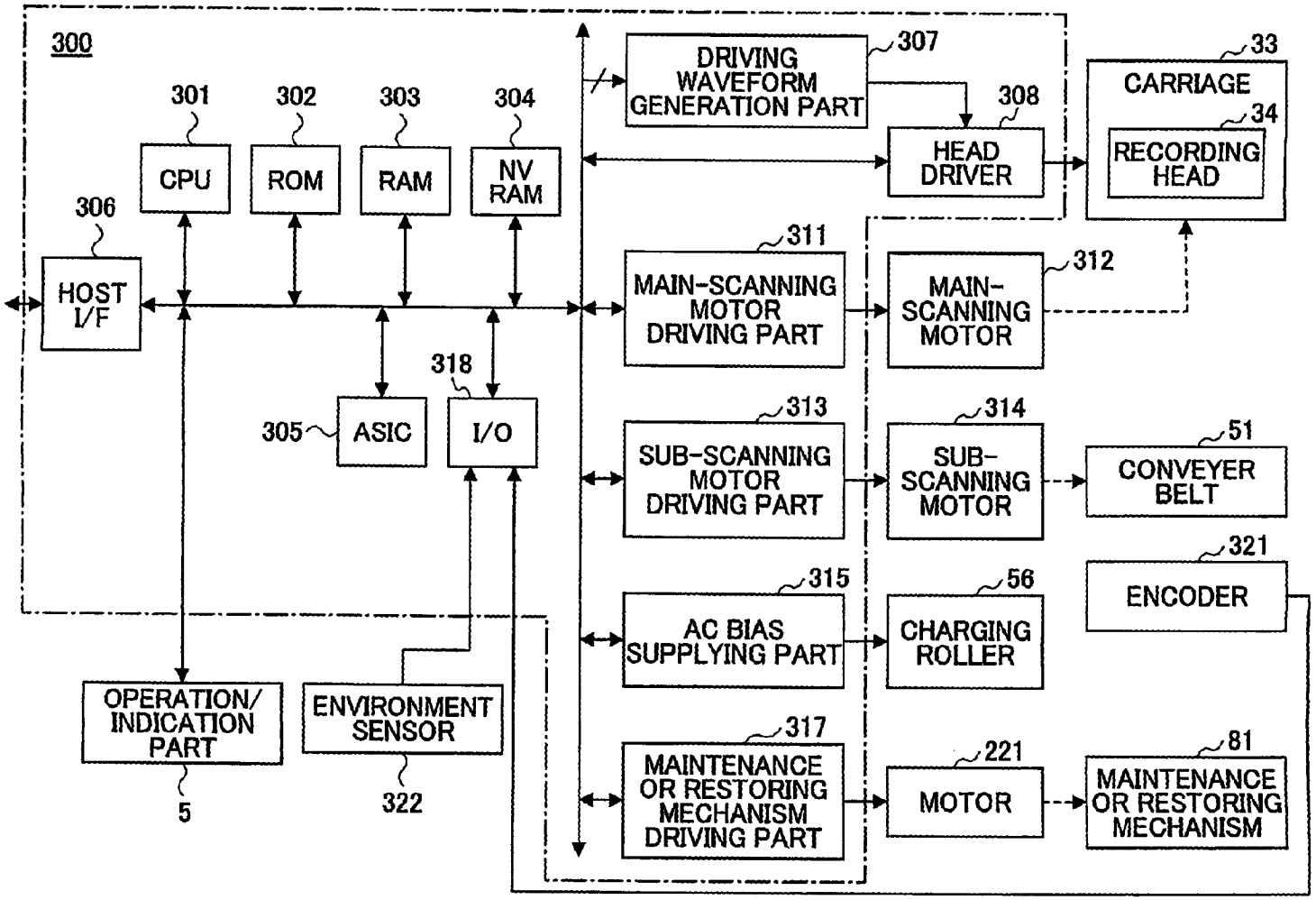
FIG. 9 is a schematic block diagram illustrating a control part of the image forming apparatus.

Next, the general configuration of the control part of the image forming apparatus is described with referring to FIG. 9. Herein, the figure is a block diagram illustrating the entirety of the control part.

The control part 300 includes a CPU 301 serving to control the entire apparatus; a ROM 302 for storing a program executed by the CPU 301, a value of contamination on a nozzle face with respect to a predetermined ink ejection and a nozzle face contamination tolerance threshold value used in the present invention, driving waveform data, and the other fixed data; a RAM 303 for temporally storing image data, etc.; a nonvolatile storage (NVRAM) 304 for holding the data while the power supply of the apparatus is turned off; and a ASIC 305 for processing each kind of signal for the image data, for image processing to perform sorting, etc., and for processing input and output signals to control the entire apparatus.

Also, the control part 300 includes an I/F 306 for transmitting to or receiving from the host side data or signals, a driving waveform generation part 307 for generating a driving waveform to drive and control a pressure generation device of the recording head 34, a head driver 308, a main-scanning motor driving part 311 for driving a main-scanning motor 312, a sub-scanning motor driving part 313 for driving a sub-scanning motor 314, an AC bias supply part 315 for supplying an AC bias to the charging roller 56, a maintenance or restoring mechanism driving part 317 for driving the motor 221 of the maintenance or restoring mechanism 81, an encoder 321 for outputting a detected signal corresponding to the movement quantity and movement velocity of the conveyer belt 51, and an I/O 318 for inputting a detected signal from a environmental sensor 322 for detecting at least one of environmental temperature and environmental humidity and a detected signal from each kind of sensor that is not shown in the figure. The control part 300 is connected to the operation/indication part 5 for performing an input or indication of necessary information for the apparatus.

The control part 300 receives printing data, etc., on the I/F 306 through a cable or network, from the host side such as an information processing apparatus such as a personal computer, an image reading apparatus such as an image scanner, and an imaging apparatus such as a digital camera.

Then, the CPU 300 reads out and analyzes printing data in a signal-receiving buffer included in the I/F 306, executes necessary image processing and data sorting processing on the ASIC 305, sends image data corresponding to one line of the recording head 34 to the head driver 308 as serial data with synchronizing to a clock signal, and also sends a latch signal or a control signal to the head driver 308 at a predetermined timing.

Then, the CPU 301 reads out and analyzes printing data in the signal-receiving buffer included in the I/F 306, executes necessary image processing and data sorting processing on the ASIC 305, and transfers image data to the head driver 308. The generation of dot pattern data for an image output may be executed, for example, by storing font data in the ROM 302 and may be transferred to the apparatus by developing the image data into bit map data on a printer driver at the host side.

The driving waveform generation part 307 includes a D/A converter for D/A-converting driving waveform pattern data and, thereby, a driving waveform composed of one driving pulse (driving signal) or plural driving pulses (driving signals) is output to the head driver 308.

The head driver 308 drives the recording head 34 by selectively applying a driving pulse constituting a driving waveform presented from the driving waveform generation part 307 to the pressure generation device of the recording head 34 based on image data (dot pattern data) corresponding to one line of the recording head 34 input in serial format.

Further, the control part 300 controls a charging pattern (provided charge quantity) on the conveyer belt 51 by performing an ON/OFF control of an AC bias supplied from the AC bias supply part 315 to the charging roller 56.

Figure 10:
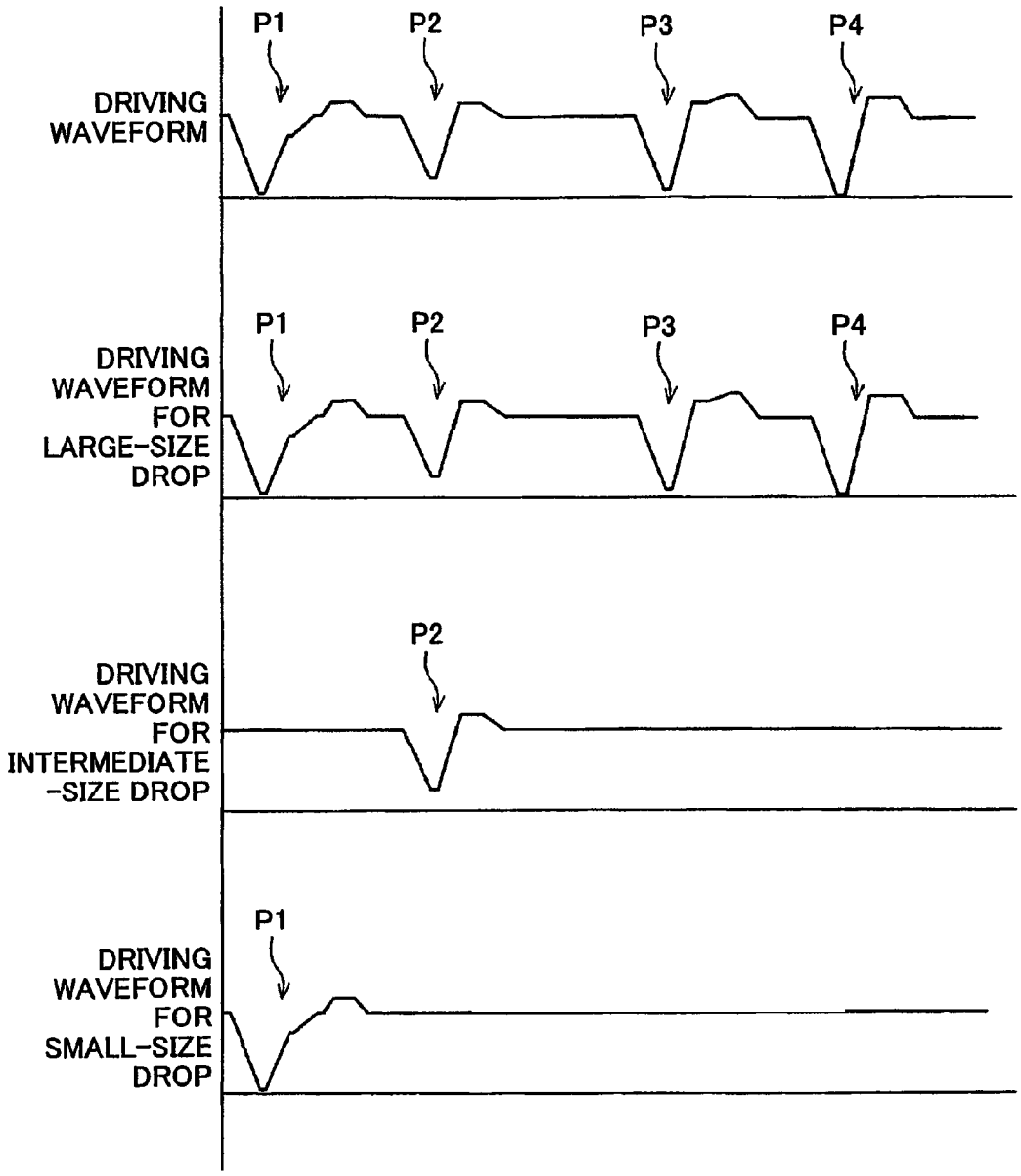
FIG. 10 is a diagram illustrating one example of driving waveforms supplied by the control part to a recording head.

Next, the driving waveform for driving the recording head 34 in the image forming apparatus is described with referring to FIG. 10 and FIG. 11.

Herein, as shown in FIG. 10, a driving waveform which includes, for example, four driving pulses P1 through P4 in one driving cycle, is generated and output from the driving waveform generation part 307. The driving waveform is composed of a driving pulse P1 for small drop ejection and large drop ejection, a driving pulse P2 for middle drop ejection and the large drop ejection, and driving pulses P3 and P4 used only for the large drop ejection; driving pulses to be used are selected depending on the size of drop to be ejected.

Figure 11A:
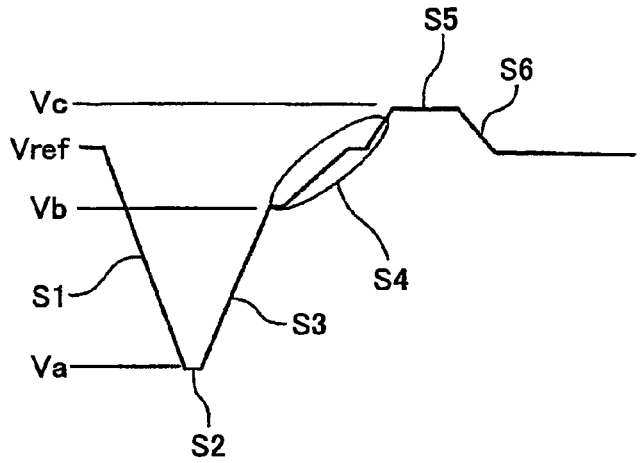
FIGS. 11A, 11B, and 11C are diagrams illustrating respective driving pulses of the driving waveforms.

As shown in FIG. 11A, the driving pulse for small drop ejection P1 includes a waveform element S1 that drops from a reference electric potential Vref to a voltage Va; a waveform element S2 that is continuous to the waveform element S1 and is retained at the voltage Va; a waveform element S3 that is continuous to the waveform element S2 and rises from the voltage Va to a voltage Vb lower than the reference electric potential Vref; a waveform element S4 that is continuous to the waveform element S3, rises to the reference electric potential Vref during a required retention time (so that drop ejection is not caused) and further rises to a voltage Vc higher than the reference electric potential Vref after the retention during the required retention time; a waveform element S5 that is continuous to the waveform element S4 and is retained at the voltage during a required time period; and a waveform element S6 that is continuous to the waveform element S5 and drops from the voltage Vc to the reference electric potential Vref.

As the driving pulse P1 is applied to the piezoelectric element 121 of the recording head 34, the piezoelectric element 121 contracts according to the waveform element S1, so that the vibration plate 102 lowers and the volume of the liquid chamber 106 expands. Then, the expanded condition is retained according to the waveform element S2. Further, the piezoelectric element 121 expands according to the waveform element S3 so that the vibration plate 102 moves to the inside of the liquid chamber and the volume of the liquid chamber 106 is reduced, whereby a liquid drop (main drop) is ejected from the nozzle 104. At this time, the ejected liquid drop is a small drop (dwarf drop) since the voltage does not rise to the reference electric potential Vref.

Then, after ejection of the main drop, the vibration plate 102 is gradually lowered under the reference position according to the waveform element S4 so that the meniscus moves to the side of the vibration plate and the volume of the liquid chamber is reduced with drop ejection. Then, the condition is retained according to the waveform element S5 so that the meniscus vibration caused by the natural vibration of the liquid chamber is suppressed. After a required time period has passes, the voltage Vc is dropped to the reference electric potential Vref according to the waveform element S6 so as to restore the vibration plate 102 to the reference position.

Figure 11B:
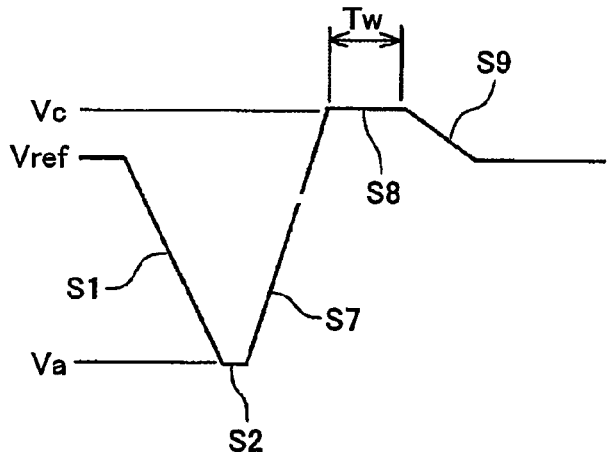

Also, as shown in FIG. 11B, the driving pulse for middle and large drops P2 and the driving pulse for large drop P4 includes the waveform element S1 that drops from the reference electric potential Vref to the voltage Va, the waveform element S2 that is continuous to the waveform element S1 and is retained at the voltage Va, a waveform element S7 that is continuous to the waveform element S2 and rises from the voltage Va to the voltage Vc higher than the reference electric potential Vref, a waveform element S8 that is continuous to the waveform element S7 and is retained at the voltage Vc during a retention time Tw in a range of Tc×½ through Tc×⅔ wherein Tc is the frequency of the natural vibration of the liquid chamber, and a waveform element S9 that is continuous to the waveform element S8 and drops from the voltage Vc to the reference electric potential Vref.

As the driving pulses P2 and P4 are applied to the piezoelectric element 121 of the recording head 34, the piezoelectric element 121 contracts according to the waveform element S1, so that the vibration plate 102 lowers and the volume of the liquid chamber 106 expands. Then, the expanded condition is retained according to the waveform element S2. Further, the piezoelectric element 121 expands according to the waveform element S7 so that the vibration plate 102 moves to the inside of the liquid chamber and the volume of the liquid chamber 106 is reduced, whereby a liquid drop (main drop) is ejected from the nozzle 104. At this time, a liquid drop (middle drop) larger than the case of the driving pulse P1 is ejected since the voltage rises to the voltage Vc.

Then, after ejection of the main drop, the vibration plate 102 is retained at a position thereof according to the waveform element S8 so that the volume of the liquid chamber is retained at the contracting condition. After the retention time Tw in a range of Tc×½ through Tc×⅔ has passed wherein Tc is the frequency of the natural vibration of the liquid chamber, the voltage Vc is dropped to the reference electric potential Vref according to the waveform element S9 so as to restore the vibration plate 102 to the reference position.

In this case, the voltage is dropped after the voltage Vd is retained during the retention time Tw in a range of Tc×½ through Tc×⅔ wherein Tc is the frequency of the natural vibration of the liquid chamber. When the meniscus moves downward with main drop ejection according to the natural vibration of the liquid chamber, the vibration plate 102 lowers so that the volume of the liquid chamber 106 increases and, therefore, the vibration of the meniscus is enhanced by superimposing the increase of the volume of the liquid chamber 106 on the natural vibration of the liquid chamber. However, since the retention time is Tc×½ or greater, the amplitude of the natural vibration of the liquid chamber is reduced. As the result, the velocity of the meniscus becomes greater and a satellite drop ejected by pressure to the side of the nozzle which pressure is caused by the natural vibration, after the ejection of the main drop, does not become a main drop. Further, since the velocity of the satellite drop becomes greater, the amount of mist between the main drop and the satellite drop is reduced. The driving waveform is referred to as an additional vibration suppression driving waveform.

Figure 11C:
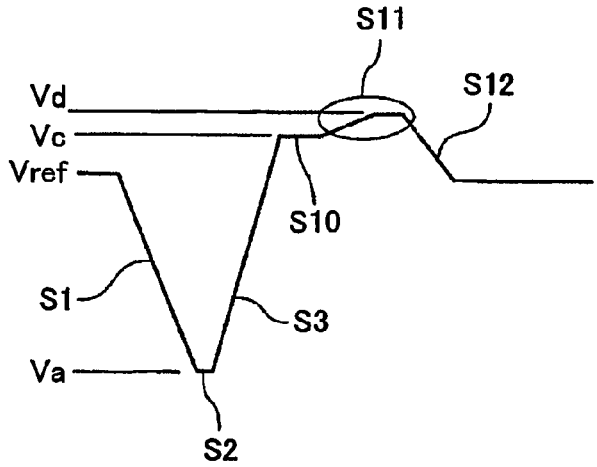

As shown in FIG. 11C, the driving pulse for large drop P3 includes the waveform element S1 that drops from the reference electric potential Vref to the voltage Va; the waveform element S2 that is continuous to the waveform element S1 and is retained at the voltage Va; the waveform element S7 that is continuous to the waveform element S2 and rises from the voltage Va to the voltage Vc higher than the reference electric potential Vref; a waveform element S10 that is continuous to the waveform element S7 and is retained at the voltage Vc during a required time period; a waveform element S11 that is continuous to the waveform element S10, further rises to a voltage Vd from the voltage Vc, and then is retained during a required time period; and a waveform element S12 that is continuous to the waveform element S11 and drops to the reference electric potential Vref.

When the driving pulse P3 is applied to the piezoelectric element 121 of the recording head 34, drop ejection is performed similar to the aforementioned driving pulses P2 and P4, and subsequently, while the meniscus moves downward with main drop ejection according to the natural vibration of the liquid chamber, the vibration plate 102 further lowers so as to reduce the volume of the liquid chamber 106 according to the waveform element S11. As a result, the vibration is suppressed (vibration suppression is made). The driving pulse P3 is referred to as a vibration suppression driving waveform.

Then, when a large drop is ejected, the driving pulses P1 through P4 are applied as shown in FIG. 10 so as to eject four liquid drops, and during the traveling of the drops, they are united to form one large drop. When a middle drop is ejected, the driving pulse P2 is selectively applied and when a small drop is ejected, the driving pulse P1 is selectively applied. Thus, dots with four grade tones which tones include no drop ejection can be formed.

Next, a process for eliminating contamination on a nozzle face, which is caused by mist adhering to the nozzle face of the recording head together with electrostatic conveyance in the image forming apparatus (referred to as "mist contamination elimination process" below), is described with referring to FIGS. 12 through 20.

First, the value of contamination on the nozzle face of the recording head, which is caused by predetermined ink ejection, is digitized and stored in the ROM 302 of the control part 300. Also, the value of contamination (contamination quantity) on the nozzle face at an allowable stage at which the value does not reach causing the failure of ejection is retained as a tolerance threshold value of contamination on the nozzle face. Herein, the value is based on the value of contamination when the failure of ejection such as the bending of ejection direction, the lack of ejection, and color mixing, is generated, which is caused by the contamination on the nozzle face of the recording head.

Figure 12:
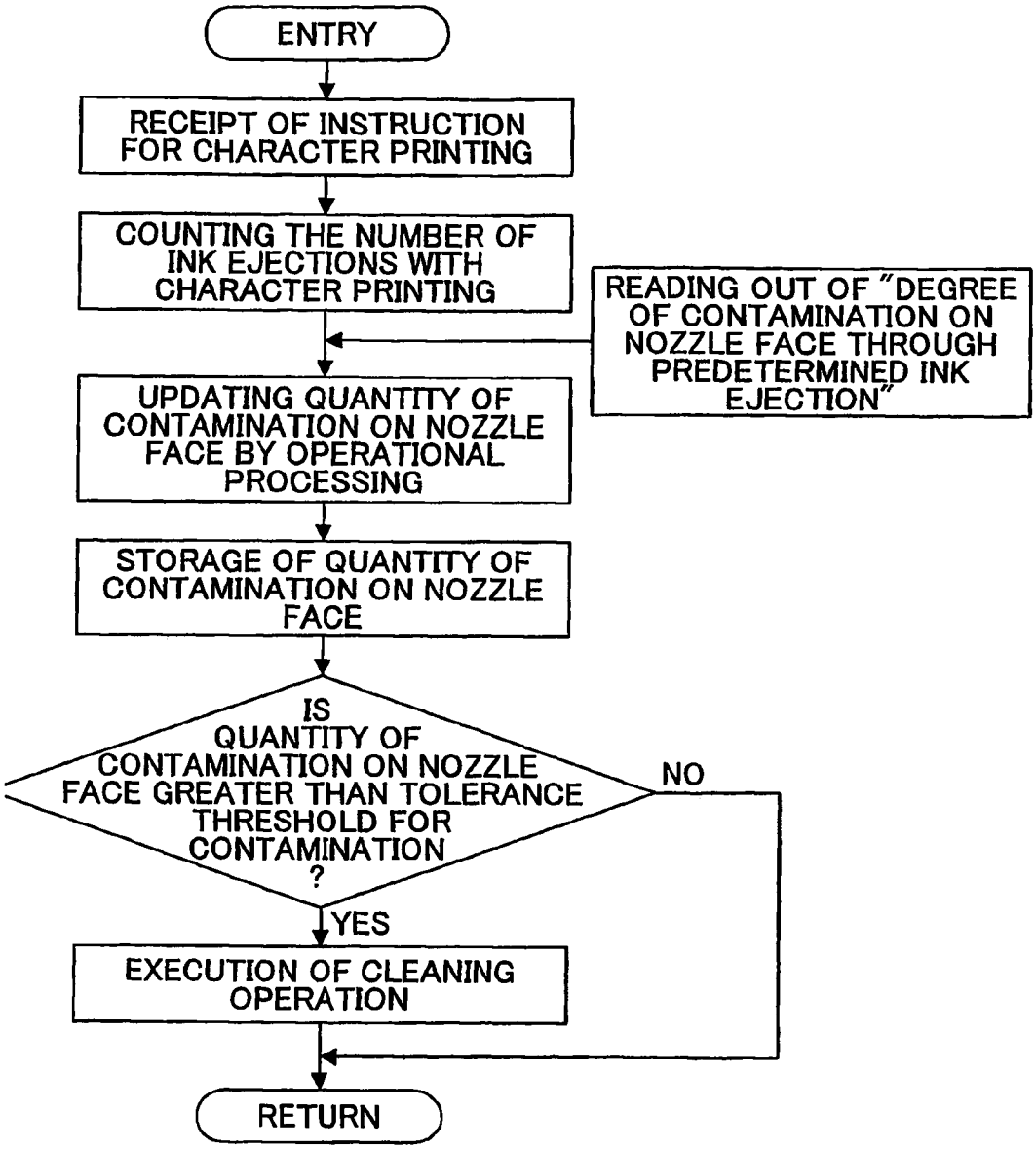
FIG. 12 is a flowchart illustrating the first embodiment of a process of eliminating contamination caused by mist which process is performed by the control part.

Then, the first embodiment of the mist contamination elimination process is described by referring to FIG. 12. In this process, as an instruction for character printing is received, a predetermined process for character printing (image formation) is performed. Also, the number of ejected ink drops is counted when the image formation is performed and the contamination on the nozzle face in the predetermined ink ejection is read out. Then, operational processing is performed based on the read out value of contamination on the nozzle face and the number of ejected ink drops such that the contamination quantity of the nozzle face is calculated and updated, and the updated contamination quantity of the nozzle face is stored.

Herein, specifically, the calculation of the contamination quantity of the nozzle face may be but is not limited to the product of obtained values such as "the value of contamination on the nozzle face in the predetermined ink ejection"× "the number of ejected ink drops"×"a correction coefficient determined by other factors".

For example, in principle, charging mist does not form on a non-charged area, that is, in the case of ejection to a location except the conveyer belt and a recording-medium that adheres to the belt, according to the generation mechanism of the mist. Therefore, when pre-ejection (blank ejection) for ejecting thickened ink inside the nozzle to a disposal liquid receiving vessel by ejection operation is performed during the image formation, it is preferable to execute a process for not reflecting the number of ink drop ejections for the pre-ejection on the contamination quantity of the nozzle face that is obtained by the operation. This can be realized, for example, by a simple method such that "the value of contamination on the nozzle face caused by the pre-ejection" is set to zero.

Afterward, whether the updated contamination quantity of the nozzle face is greater than the tolerance threshold value of contamination on the nozzle face is determined. Then, when the updated contamination quantity of the nozzle face is equal to or less than the tolerance threshold value of the contamination on the nozzle face, the value of contamination on the nozzle face 34*a* of the recording head 34 at this stage, which contamination is caused by the mist, is determined to be in a allowable range and the process is completed without any more process steps.

On the other hand, when the updated contamination quantity of the nozzle face is greater than the tolerance threshold value of the contamination on the nozzle face, the value of contamination on the nozzle face 34*a* of the recording head 34 at that stage, which contamination is caused by the mist, is determined to be in an unallowable condition. Then, the wiper blade 83 is lifted and a cleaning operation (wiping operation) for wiping the nozzle face 34*a* of the recording head 34 is performed.

Thus, in the image forming apparatus in which the contamination on the nozzle face is easily caused by adhesion of charged mist (charging mist) on the nozzle face of the recording head with the electrostatic conveyance, the restoring operation can be performed without excess or deficiency so as to clean the nozzle face effectively and the degradation of image quality can be prevented, by previously digitizing and storing the value of contamination on the nozzle face caused by the predetermined ink ejection, counting the number of ejected ink drops during the operation of image formation, calculating the value of contamination on the nozzle face by the operation with the retained value of contamination on the nozzle face, comparing the operation result with the tolerance threshold value of contamination on the nozzle face at a predetermined timing, and performing the operation for cleaning the nozzle face when the value of contamination on the nozzle face is greater then the threshold value.

Herein, the tolerance threshold value of contamination on the nozzle face is a value corresponding to the condition of generating the failure of ejection such as the bending of ejection direction, the lack of ejection, and color mixing if the contamination is over the threshold value, and is digitized by the same method as the value of contamination on the nozzle face caused by the predetermined ink ejection. Accordingly, the operation of cleaning the nozzle face at an unnecessary timing can be avoided so as to prevent waste of ink or time. Additionally, "predetermined ink ejection (predetermined ink drop ejection)" may be, for example, "per ejected one drop". In the case of forming one drop for forming an image from plural sub-drops, it may be "per one sub-drop".

Figure 13:
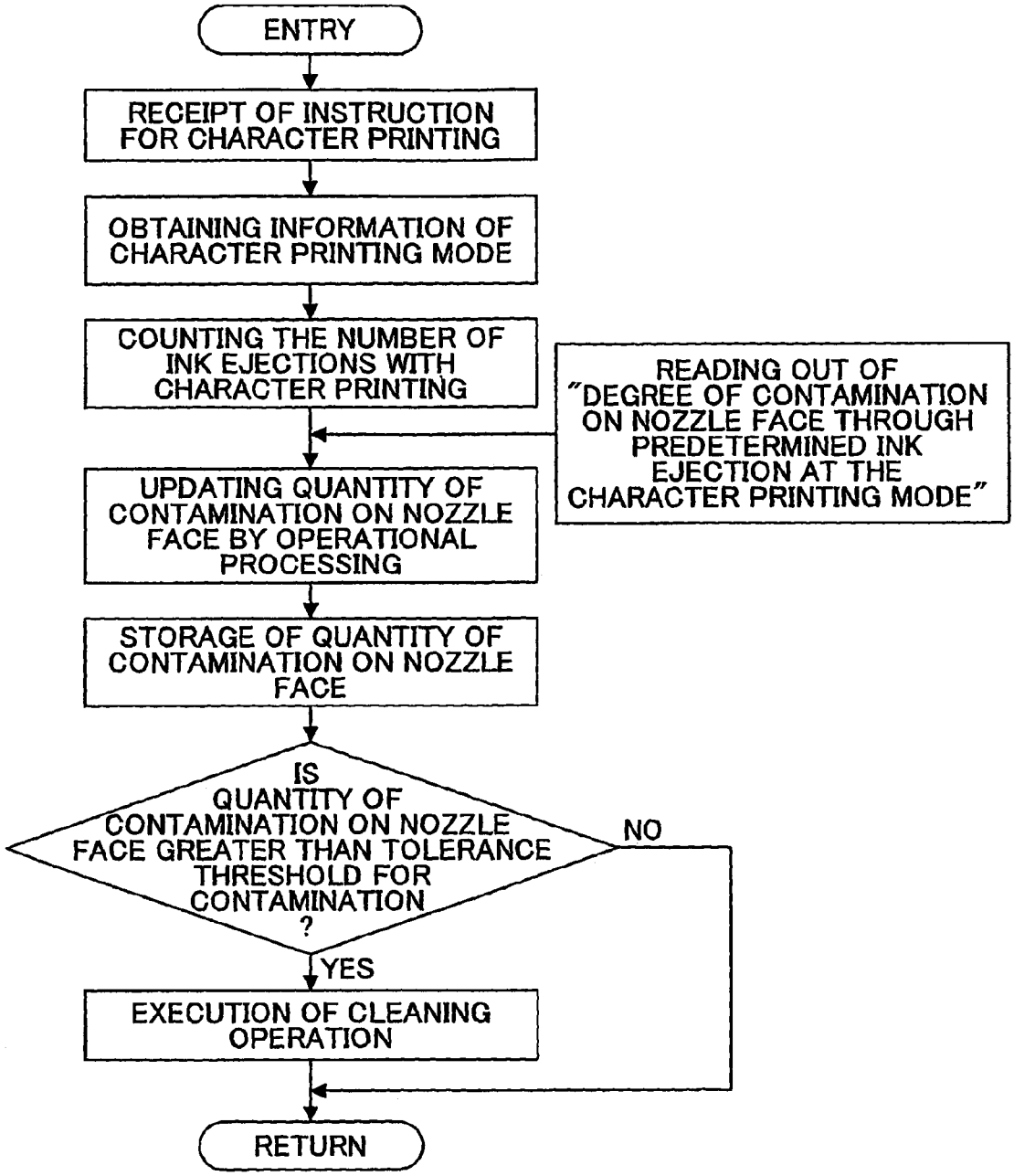
FIG. 13 is a flowchart illustrating the second embodiment of a process of eliminating contamination caused by mist which process is performed by the control part.

Next, the second embodiment of the mist contamination elimination process is described by referring to FIG. 13. In this process, as an instruction for character printing is received, the information of a printing mode in regard to whether the (character) printing mode is a one-face printing mode or a double-face printing mode is obtained. Afterward, a predetermined process for character printing (image formation) is performed. Also, the number of ejected ink drops is counted when the image formation is performed and the retained value of contamination on the nozzle face in the predetermined ink ejection at the character printing mode is read out. Then, operational processing is performed based on the read out value of contamination on the nozzle face and the number of ejected ink drops such that the contamination quantity of the nozzle face is calculated and updated, and the updated contamination quantity of the nozzle face is stored.

Afterward, similar to the first embodiment of the mist contamination elimination process, when the contamination quantity of the nozzle face is equal to or less than the tolerance threshold value of the contamination on the nozzle face, the process is completed without any more process steps. When the contamination quantity of the nozzle face is greater than the tolerance threshold value of the contamination on the nozzle face, a cleaning operation (wiping operation) for wiping the nozzle face 34*a* of the recording head 34 is performed.

Herein, the relation between "the character printing mode" and the retained "value of contamination on the nozzle face in the predetermined ink ejection" is described.

The quantity of generated charging mist changes depending on the charging condition on the surface of a recording-medium, the charging condition on the surface of the recording-medium is influenced with the dryness of the recording-medium. In this case, when the character printing mode (printing mode) is one-face printing, an image is formed on the dried surface of the recording-medium. On the other hand, when it is double-face printing, the first face (referred to as a face to be printed previously, a front face or one face) on which an image is formed is a dried surface of the recording-medium and the second face (referred to as a face to be printed latterly, a back face, or the other face) is frequently in the condition of being wetted by previously adhered ink drops. Then, the more the recording-medium dries, the more the charging of an ink drop is easily caused by the charge provided on the conveyer belt for the adhesive conveyance, at the time of image formation.

Herein, "the value of contamination on the nozzle face in the predetermined ink ejection" is set such that when the character printing mode is the one face printing mode, the number (frequency) of cleanings is relatively high and when it is the double-face printing mode, the number (frequency) of cleanings is relatively low. Therefore, the calculation of the value (quantity) of contamination on the nozzle face based on the number of ejected ink drops can correspond to the character printing mode and unnecessary cleaning operations can be reduced.

Figure 14:
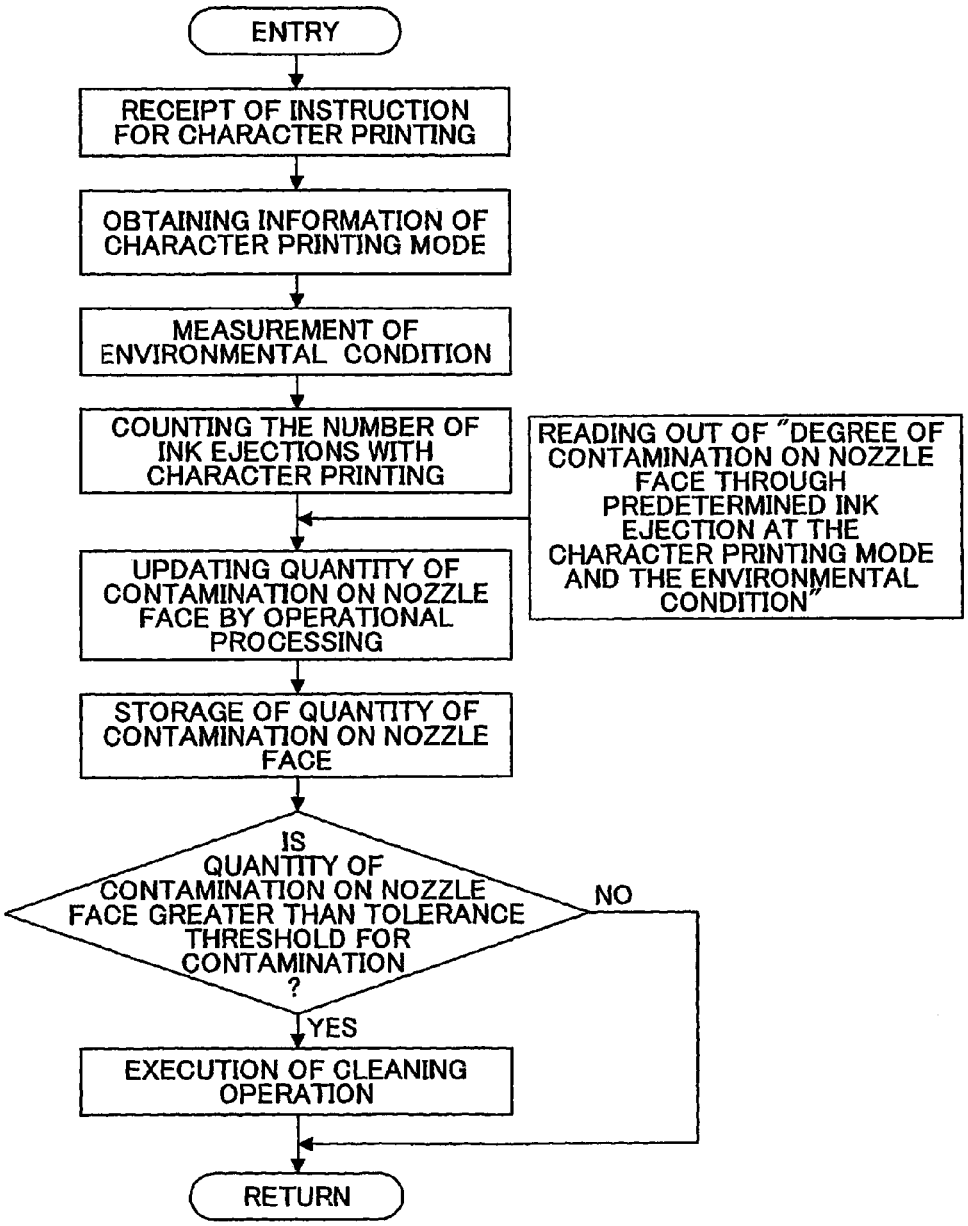
FIG. 14 is a flowchart illustrating the third embodiment of a process of eliminating contamination caused by mist which process is performed by the control part.

Next, the third embodiment of mist contamination elimination process is described with referring to FIG. 14. In this process, as an instruction for character printing is received, the information of a printing mode in regard to whether the (character) printing mode is one-face printing mode or double-face printing mode is obtained. Afterward, an environmental condition (at least one of environmental temperature and environmental humidity) is measured based on a detected signal from the environmental sensor 222. Then, a predetermined process for character printing (image formation) is performed. Also, the number of ejected ink drops is counted when the image formation is performed and the retained value of contamination on the nozzle face in the predetermined ink ejection, and the character printing mode and the environmental condition are read out. Then, operational processing is performed based on the read out value of contamination on the nozzle face and the number of ejected ink drops such that the contamination quantity of the nozzle face is calculated and updated, and the updated contamination quantity of the nozzle face is stored.

Afterward, similar to the first embodiment of the mist contamination elimination process, when the contamination quantity of the nozzle face is equal to or less than the tolerance threshold value of the contamination on the nozzle face, the process is completed without any more process steps. When the contamination quantity of the nozzle face is greater than the tolerance threshold value of the contamination on the nozzle face, a cleaning operation (wiping operation) for wiping the nozzle face 34*a* of the recording head 34 is performed.

Herein, the relation between "the environmental condition" and the retained "value of contamination on the nozzle face in the predetermined ink ejection" is described.

As described above, the quantity of generating charging mist changes depending on the charging condition on the surface of a recording-medium, and the charging condition on the surface of the recording-medium is influenced by the dryness of the recording-medium. Therefore, the value of generation of the charging mist significantly changes depending on the environmental temperature and the environmental humidity.

Although the whole mechanism has not been elucidated yet, when the environmental humidity is low, the recording-medium itself dries and is easily charged with static electricity by a charge provided on the conveyer belt for the adhesive conveyance, whereby the amount of charging mist increases. In this case, the lower the environmental humidity is, whether it is relative humidity or absolute humidity, the more the charging mist tends to be easily generated. Also, when the environmental humidity is low, the absolute content of moisture contained in air is low even at the same relative humidity and the medium is easily charged with static electricity. Therefore, the amount of the charging mist increases. Further, in the case of low temperature, it is considered that since the viscosity of the ink increases and the mist is easily generated at the time of ink ejection, the amount of the ink flowing back to the nozzle face is increased by the charge provided on the conveyer device and the amount of the charging mist increases.

Then, the values of contamination on the nozzle face in the predetermined ink ejection are retained as values dependent on at least one of the environmental temperature and the environmental humidity, and the contamination quantity of the nozzle face in the operation of image formation is calculated using the value of contamination on the nozzle face which corresponds to the measurement value of at least one of the environmental temperature and the environmental humidity. Therefore, the operation of cleaning the nozzle face can be executed depending on the use environment of the image forming apparatus at a proper timing, whereby unnecessary cleaning operations can be reduced and efficient cleaning operations can be attained.

Additionally, in this example, since the value of contamination on the nozzle face in the predetermined ink ejection is set based on the printing mode and the environmental conditions, a cleaning operation that is more efficient than the second embodiment can be performed. However, the value of contamination on the nozzle face in the predetermined ink ejection may be set based on only the environmental conditions.

Figure 15:
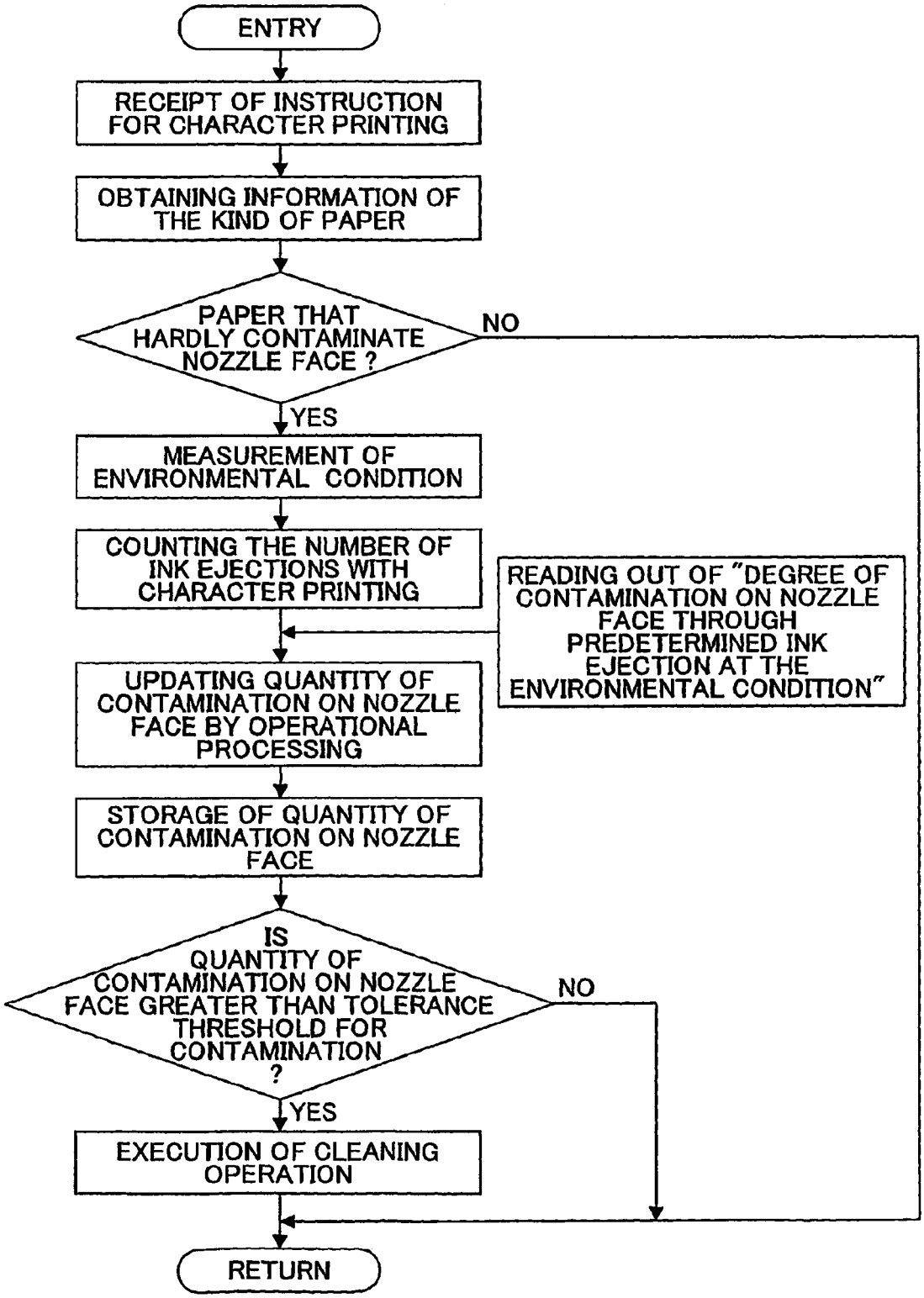
FIG. 15 is a flowchart illustrating the fourth embodiment of a process of eliminating contamination caused by mist which process is performed by the control part.

Next, the fourth embodiment of mist contamination elimination process is described with referring to FIG. 15. In this process, as an instruction for character printing is received, information with respect to the kind of a recording-medium (information for the kind of paper) is obtained and whether the recording-medium is a paper that hardly contaminates the nozzle face is determined.

Then, when the recording-medium is a paper that hardly contaminates the nozzle face, the process is completed without any more process steps. On the other hand, when the recording-medium is not a paper that hardly contaminates the nozzle face, the environmental condition (at least one of the environmental temperature and the environmental humidity) is measured. Afterward, a predetermined process for character printing (image formation) is performed. Also, the number of ejected ink drops is counted when the image formation is performed and the retained value of contamination on the nozzle face in the predetermined ink ejection at the environmental condition is read out. Then, operational processing is performed based on the read out value of contamination on the nozzle face and the counted number of ejected ink drops such that the contamination quantity of the nozzle face is calculated and updated, and the updated contamination quantity of the nozzle face is stored.

Afterward, similar to the first embodiment of the mist contamination elimination process, when the contamination quantity of the nozzle face is equal to or less than the tolerance threshold value of contamination on the nozzle face, the process is completed without any more process steps. When the contamination quantity of the nozzle face is greater than the tolerance threshold value of contamination on the nozzle face, a cleaning operation (wiping operation) for wiping the nozzle face 34*a* of the recording head 34 is performed.

Herein, the relation between "the kind of recording-medium" and the nozzle contamination caused by the mist is described. As described above, the charging mist is generated by charging of an image formation face of the recording-medium which is caused by the influence of a charge provided on the conveyer device and accordingly charging of ejected ink. Therefore, when the recording-medium has a physical thickness such that the charge provided on the conveyer device does not influence the image formation face (recording face), or has a high electrical shielding effect, the image formation face of the recording-medium that opposes the nozzle face of the recording head is seldom charged with static electricity, and therefore, the generation of the charging mist is significantly reduced.

Thus, when the recording-medium is such a medium that hardly generates the charging mist, that is, a medium that hardly contaminates the nozzle face of the recording head by the charging mist, no cleaning operation is performed, so that an unnecessary cleaning operation can be reduced.

Next, the fifth embodiment of mist contamination elimination process is described with referring to FIG. 16. In this process, as an instruction for character printing is received, information of a character printing mode and information with respect to the kind of a recording-medium (information for the kind of paper) are obtained and whether the recording-medium is a paper that hardly contaminates the nozzle face is determined.

Then, when the recording-medium is a paper that hardly contaminates the nozzle face, the process is completed without any more process steps. On the other hand, when the recording-medium is not a paper that hardly contaminates the nozzle face, the environmental condition (at least one of the environmental temperature and the environmental humidity) is measured. Afterward, a predetermined process for character printing (image formation) is performed. Also, the number of ejected ink drops is counted when the image formation is performed and the retained value of contamination on the nozzle face in the predetermined ink ejection, and the character printing mode and the environmental condition are read out. Then, operational processing is performed based on the read out value of contamination on the nozzle face and the counted number of ejected ink drops such that the contamination quantity of the nozzle face is calculated and updated, and the updated contamination quantity of the nozzle face is stored.

Afterward, similar to the first embodiment of the mist contamination elimination process, when the contamination quantity of the nozzle face is equal to or less than the tolerance threshold value of contamination on the nozzle face, the process is completed without any more process steps. When the contamination quantity of the nozzle face is greater than the tolerance threshold value of the contamination on the nozzle face, a cleaning operation (wiping operation) for wiping the nozzle face 34*a* of the recording head 34 is performed.

By performing such a process, a cleaning operation can be performed more appropriately which corresponds to the value of contamination caused by charging mist on the nozzle face of the recording head.

Figure 17:
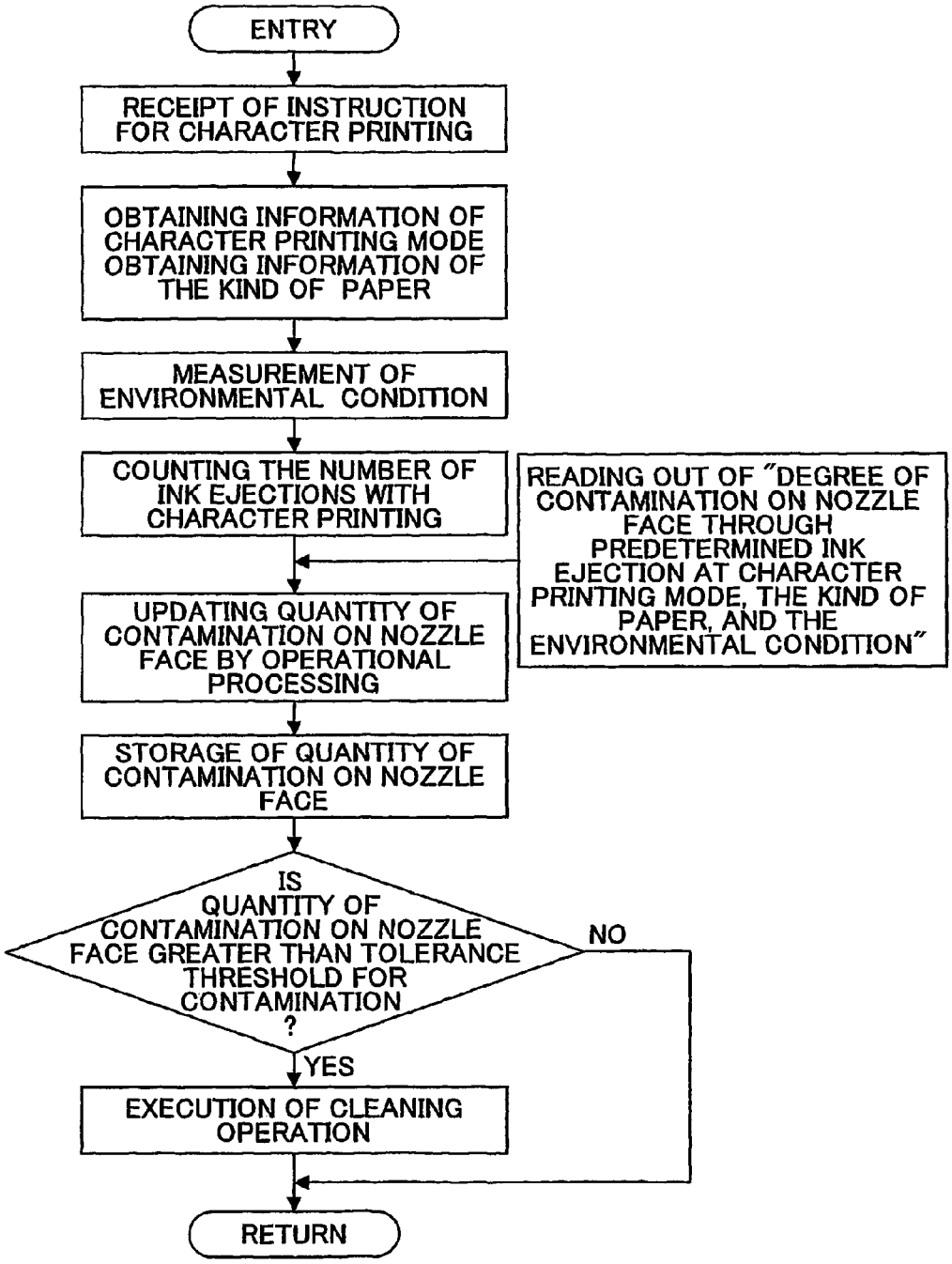
FIG. 17 is a flowchart illustrating the sixth embodiment of a process of eliminating contamination caused by mist which process is performed by the control part.

Next, the sixth embodiment of mist contamination elimination process is described with referring to FIG. 17. In this process, as an instruction for character printing is received, information of a character printing mode and information with respect to the kind of a recording-medium (information for the kind of paper) are obtained and subsequently the environmental condition (at least one of the environmental temperature and the environmental humidity) is measured. Afterward, a predetermined process for character printing (image formation) is performed. Also, the number of ejected ink drops is counted when the image formation is performed and the retained value of contamination on the nozzle face in the predetermined ink ejection, and the character printing mode, the kind of the paper, and the environmental condition are read out. Then, operational processing is performed based on the read out value of contamination on the nozzle face and the counted number of ejected ink drops such that the contamination quantity of the nozzle face is calculated and updated, and the updated contamination quantity of the nozzle face is stored.

Afterward, similar to the first embodiment of the mist contamination elimination process, when the contamination quantity of the nozzle face is equal to or less than the tolerance threshold value of contamination on the nozzle face, the process is completed without any more process steps. When the contamination quantity of the nozzle face is greater than the tolerance threshold value of the contamination on the nozzle face, a cleaning operation (wiping operation) for wiping the nozzle face 34*a* of the recording head 34 is performed.

Herein, whereas no cleaning operation is executed for a certain kind of recording-medium in the fourth and fifth embodiments, "the values of contamination on the nozzle face in the predetermined ink ejection" are retained as values dependent on "the kinds of mediums to be recorded", and the contamination quantity of the nozzle face in the operation of image formation is calculated using the value of contamination on the nozzle face which corresponds to the kind of recording-medium on which image formation is performed. Therefore, the operation of cleaning the nozzle face can be executed depending on the kind of recording-medium at a proper timing, whereby unnecessary cleaning operations can be reduced and efficient cleaning operations can be attained.

Additionally, in this example, although the combination of the character printing mode and the environmental condition is adopted, "the values of contamination on the nozzle face in the predetermined ink ejection" may be set depending on only the kind of recording-medium.

Figure 18:
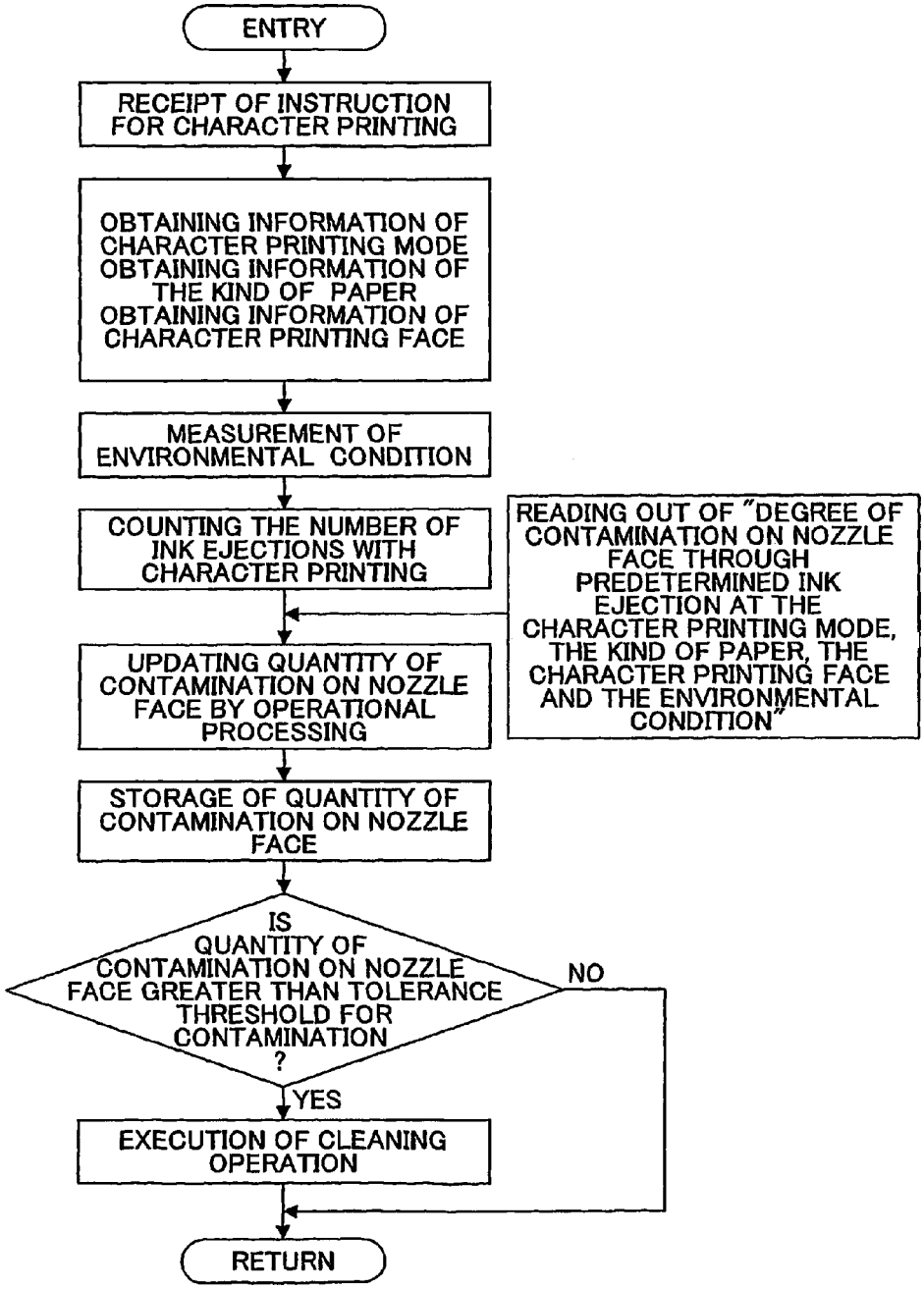
FIG. 18 is a flowchart illustrating the seventh embodiment of a process of eliminating contamination caused by mist which process is performed by the control part.

Next, the seventh embodiment of mist contamination elimination process is described with referring to FIG. 18. In this process, as an instruction for character printing is received, information of a character printing mode, information with respect to the kind of a recording-medium (information for the kind of paper), and character printing face information with respect to whether a character printing face is the first face or the second face are obtained and subsequently the environmental condition (at least one of the environmental temperature and the environmental humidity) is measured. Afterward, a predetermined process for character printing (image formation) is performed. Also, the number of ejected ink drops is counted when the image formation is performed and the retained value of contamination on the nozzle face in the predetermined ink ejection, the character printing mode, the kind of the paper, the character printing face and the environmental condition are read out. Then, operational processing is performed based on the read out value of contamination on the nozzle face and the counted number of ejected ink drops such that the contamination quantity of the nozzle face is calculated and updated, and the updated contamination quantity of the nozzle face is stored.

Afterward, similar to the first embodiment of the mist contamination elimination process, when the contamination quantity of the nozzle face is equal to or less than the tolerance threshold value of contamination on the nozzle face, the process is completed without any more process steps. When the contamination quantity of the nozzle face is greater than the tolerance threshold value of contamination on the nozzle face, a cleaning operation (wiping operation) for wiping the nozzle face 34*a* of the recording head 34 is performed.

As described above, the generation of the charging mist is reduced in the case of performing character printing on the second face in the double-face character printing mode, compared to in the case of performing character printing in the one-face character printing mode or on the first face in the double-face character printing mode, and the value of contamination caused by the charging mist on the nozzle face is also reduced. Then, "the values of contamination on the nozzle face in the predetermined ink ejection" are retained as values dependent on "the character printing faces", and the contamination quantity of the nozzle face in the operation of image formation is calculated using the value of contamination on the nozzle face which corresponds to the character printing face of the recording-medium on which face image formation is performed. Therefore, the operation of cleaning the nozzle face can be executed depending on the printing face of the recording-medium at a proper timing, whereby unnecessary cleaning operations can be reduced and efficient cleaning operations can be attained.

Additionally, in this example, although the combination of the character printing mode, the kind of paper (the kind of recording-medium) and the environmental condition is adopted, "the values of contamination on the nozzle face in the predetermined ink ejection" may be set depending on only the character printing face.

Also, the influence of charging of a recording-medium to the bending of ejection direction of an ink liquid depends on the kind of ink. The reason is considered to be that the polarization property of ink in a charging condition depends on the kind of ink.

Therefore, for the ink that generates a higher quantity of the charging mist, the retained value of contamination on the nozzle face in the predetermined ink ejection is set to be a larger value. On the other hand, for the ink that generates a lower quantity of the charging mist, the retained value of contamination on the nozzle face in the predetermined ink ejection is set to be a smaller value and the kind of used ink is recognized. Then, the value of contamination on the nozzle face in the predetermined ink ejection at the kind of the ink is used for the calculation of the value of contamination on the nozzle face, thereby performing without excess or deficiency the operation for cleaning the nozzle face which is suitable for the property of the ink. This mist contamination elimination process for performing the cleaning operation for the nozzle face depending on the kind of ink can be combined with any of the first through sixth embodiments.

Figure 19:
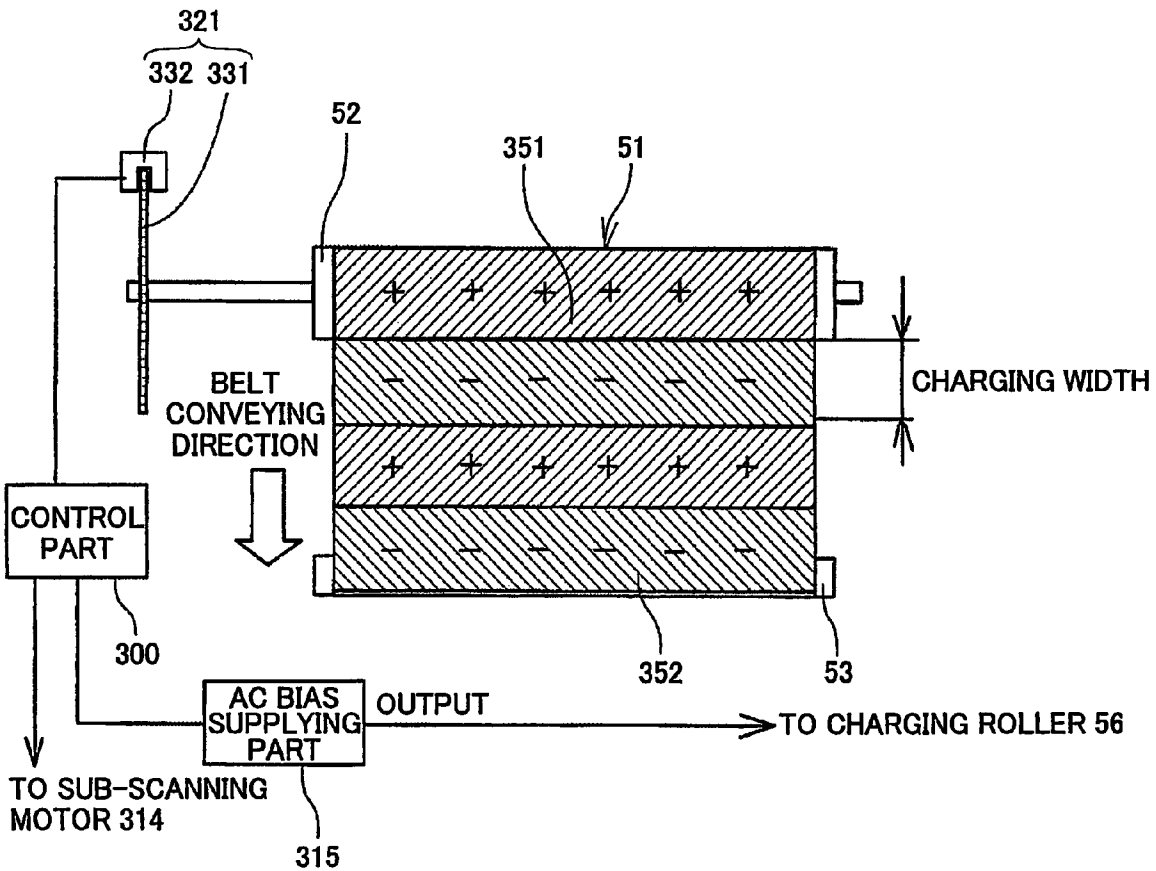
FIG. 19 is a diagram illustrating the charging control for a conveyer belt by the control part.
Figure 20:
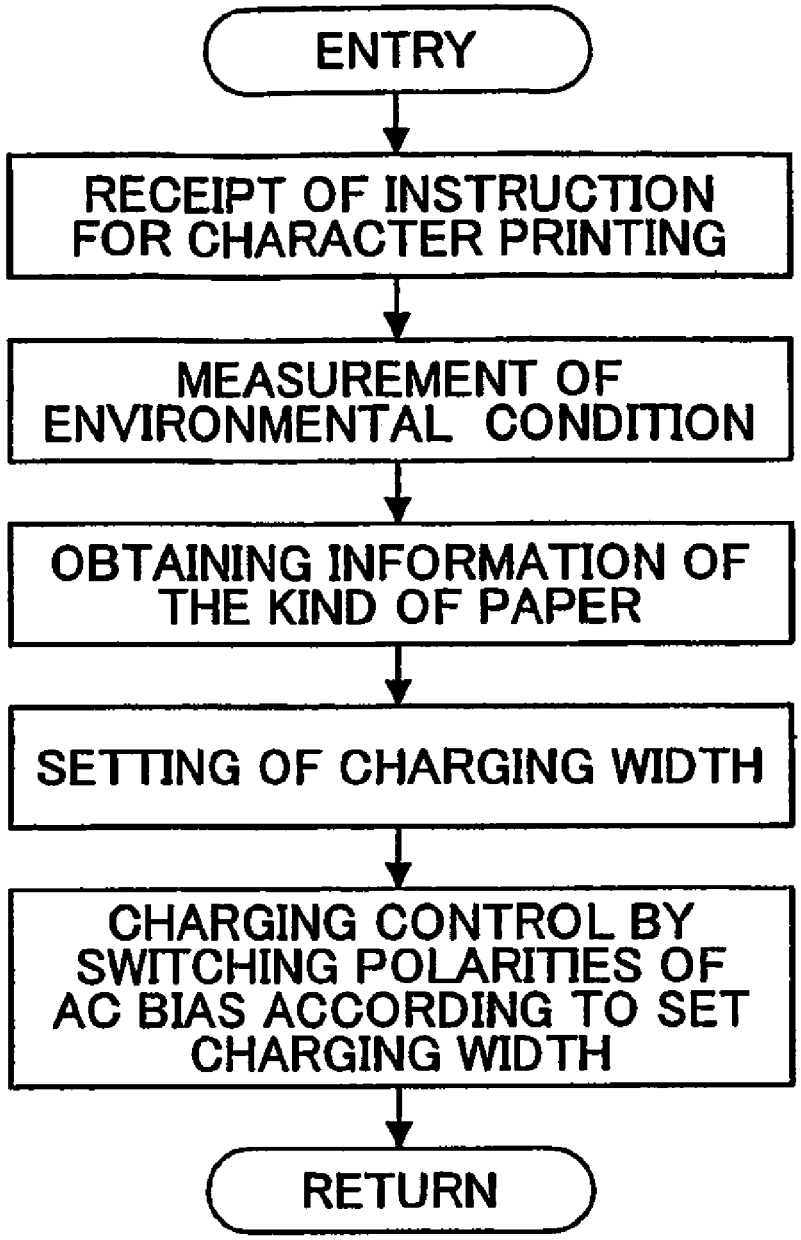
FIG. 20 is a flowchart illustrating a process of charging width control for a conveyer belt by the control part.

Next, a charge providing control operation for the conveyer belt as a conveyer device is described with referring to FIG. 19 and FIG. 20.

The movement quantity of the conveyer belt 51 is detected based on a detected signal from an encoder 321 including a slit disk 331 and a photo-sensor 332 which encoder is provided on an edge portion of the conveyer roller 52 for driving the conveyer belt 51. The sub-scanning motor 314 is driven and controlled by the control part 300 and the sub-scanning motor driving part 313 according to the detected movement quantity and an output from the AC bias supplying part 315 for applying a high voltage (AC bias) to the charging roller 56 is controlled.

The presence or absence of charge application on the charging roller, the frequency of positively-polar and negatively-polar applied voltages, the width of each polar area in the conveyance directions (the charging width of a positively polar charging pattern 351 and a negatively polar charging pattern 352 on the conveyer belt 51), etc., can be controlled by controlling the output from the AC bias supplying part 315.

As described above, a charge on a recording-medium which is generated by providing the charge on the conveyer belt 51 depends on the environmental temperature, the environmental humidity, and the kind of the recording-medium.

Then, as shown in FIG. 20, as an instruction for character printing is received, at least one of environmental temperature and environmental humidity (an environmental condition) is measured and, subsequently, information for the kind of a recording-medium (the kind of paper) is obtained. The width of a charging pattern (charging width) on the conveyer belt 51 is set based on the environmental condition and the kind of paper, and the alternating frequency of positively charging and negatively charging the AC bias (high voltage) applied from the AC bias supplying part 315 to the charging roller 56 is set in accordance with the set charging width, and charging control for changing the output (polarity) from the AC bias supplying part 315 at the set frequency is performed.

Accordingly, the quantity of a charge provided on the conveyer belt 51 can be controlled. Also, while a stable electrostatically conveying force for a conveyed recording-medium, which force is dependent on the environmental condition or the kind of the recording-medium, is ensured, the contamination on the nozzle face of the recording head which contamination is caused by the generation of charging mist caused by charging the conveyer belt 51 and the flowing back of the mist can be reduced as much as possible.

Next, practical examples are described below but the present invention is not limited to these examples. Herein, the configuration of a used image forming apparatus, the number of papers for evaluation, used ink, and the papers (recording media) are as follows.

(Used Image Forming Apparatus)

A printer having the configuration of an image forming apparatus according to the embodiment of the present invention was used and 10 sets of 250 paper printings were performed for image evaluation. Immediately when an image failure such as the lack of ejection was observed during the printings, manual cleaning was performed by an evaluator.

(Inks)

The compositions of inks were as follows.

[Black Ink]

Black pigment for black ink: 50% by weight
Polyhydric alcohol: 25% by weight
Penetration accelerator: 2% by weight
Surface active agent: 3% by weight
Antifoaming agent: 0.1% by weight
Ion-exchanged water: balance

[Yellow Ink]

Dispersion of polymeric fine particles, which contains a yellow pigment: 40% by weight
Polyhydric alcohol: 28% by weight
Penetration accelerator: 2% by weight
Surface active agent: 1.5% by weight Antifoaming agent: 0.1% by weight Ion-exchanged water: balance

[Magenta Ink]

Dispersion of polymeric fine particles, which contains a magenta pigment: 50% by weight Polyhydric alcohol: 28% by weight Penetration accelerator: 2% by weight Surface active agent: 1.5% by weight Antifoaming agent: 0.1% by weight Ion-exchanged water: balance

[Cyan Ink]

Dispersion of polymeric fine particles, which contains a cyan pigment: 40% by weight Polyhydric alcohol: 28% by weight Penetration accelerator: 2% by weight Surface active agent: 1.5% by weight Antifoaming agent: 0.1% by weight Ion-exchanged water: balance The ink compositions formulated as described above were prepared and stirred sufficiently at room temperature, and subsequently, filtration using a membrane filter with an average pore size of 1.2 μm was performed. Thus obtained ink compositions were used.

(Papers Used for Character Printings)

Normal papers (My paper (Commercial name) produced by NBS Ricoh Co., Ltd.)

The conditions (referred to as "automatic performance conditions", below) were set as shown in Table 1 on which the printer spontaneously (automatically) performed an operation for cleaning a nozzle face (cleaning operation) based on the values of contamination caused by predetermined ink ejection on the nozzle face, the number of ejected ink drops, and a tolerance threshold value of contamination on the nozzle face.

TABLE 1

| Automatic performance condition | Contents |
|---|---|
| A | The following values are used for all the environmental conditions.<br>"the values of contamination caused by predetermined ink ejection on the nozzle face"<br>Black: 20<br>Cyan: 18<br>Magenta: 18<br>Yellow: 18<br>"tolerance threshold value of contamination on the nozzle face": 8000 |
| B | (1) The following values are used in the case of 10° C. or less or 15 RH % or less.<br>"the values of contamination caused by predetermined ink ejection on the nozzle face"<br>Black: 80<br>Cyan: 70<br>Magenta: 70<br>Yellow: 60<br>"tolerance threshold value of contamination on the nozzle face": 8000<br>(2) the values of condition A are used for other environmental conditions. |
| C | No spontaneous cleaning operation is performed. |

The dependence of the values on printing faces was set as shown in Table 2.

TABLE 2

| Printing mode | Contents |
|---|---|
| M | "The values of contamination caused by predetermined ink ejection on the nozzle face" are same for both the first face and the second face. |
| N | "The values of contamination caused by predetermined ink ejection on the nozzle face" for the second face is 70% of "the values of contamination caused by predetermined ink ejection on the nozzle face" for the first face. |

The dependence of the values on the control for supplying charge to the conveyer belt 51 was set as shown in Table 3.

TABLE 3

| Charge supplying control | Contents |
|---|---|
| X | The charging width (quantity of a supplied charge) was set to be constant independent of temperature or humidity. |
| Y | The charging width was reduced (charge supplying control was relieved) at a humidity of 15 RH % or less. |

(Evaluation Standard)

When the total number of the manual cleanings by the evaluator was 5 times or more, the evaluation was "x". When the total number of the manual cleanings by the evaluator was any of 1 through 4 times, the evaluation was "Δ". When the total number of the manual cleanings by the evaluator was 0 times, the evaluation was "○". When excess spontaneous cleanings were required, the explanation for them is appended.

PRACTICAL EXAMPLE 1

The automatic performance condition of "A", the dependence on the character printing mode of "M", the charge supplying control of "X", "23° C. and 50%" and "one-face character printing" as other conditions were employed. The result of evaluation was "○".

PRACTICAL EXAMPLE 2

The automatic performance condition of "A", the dependence on the character printing mode of "N", the charge supplying control of "X", "23° C. and 50%" and "double-face character printing" as other conditions were employed. The result of evaluation was "○". From this result, it was confirmed that the cleaning operation was performed without excess or deficiency also in the double-face character printing mode.

PRACTICAL EXAMPLE 3

The automatic performance condition of "A", the dependence on the character printing mode of "M", the charge supplying control of "X", "23° C. and 50%" and "double-face character printing" as other conditions were employed. The result of evaluation was "○". However, the quantity of ink that had not been consumed and remained was smaller than the case of practical example 2. That is, more ink was consumed through the automatic cleaning operation than the case of practical example 2. Consequently, it was confirmed that the value of contamination on the nozzle face for the second face was so large that the number of the cleaning operations was slightly higher.

PRACTICAL EXAMPLE 4

The automatic performance condition of "A", the dependence on the character printing mode of "M", the charge supplying control of "X", "10° C. and 15%" and "one-face character printing" as other conditions were employed. The result of evaluation was "Δ". Thus, it was confirmed that the value of contamination on the nozzle face was practically large on the conditions of lower temperature and lower humidity, and the cleaning operation tended to be insufficient but a generally good result could be obtained.

PRACTICAL EXAMPLE 5

The automatic performance condition of "A", the dependence on the character printing mode of "M", the charge supplying control of "Y", "10° C. and 15%" and "one-face character printing" as other conditions were employed. The result of evaluation was "○". Thus, it was confirmed that the contamination on the nozzle face was reduced and the cleaning operation was performed without excess or deficiency by relieving the control for providing a charge on the conveyer belt, on the conditions of lower temperature and lower humidity.

PRACTICAL EXAMPLE 6

The automatic performance condition of "B", the dependence on the character printing mode of "M", the charge supplying control of "X", "10° C. and 15%" and "one-face character printing" as other conditions were employed. The result of evaluation was "○". Thus, it was confirmed that the cleaning operation was performed without excess or deficiency by the control using a higher value of contamination on the nozzle face, on the conditions of lower temperature and lower humidity.

COMPARATIVE EXAMPLE 1

The automatic performance condition of "C" (the cleaning operation was not automatically performed.), the dependence on the character printing mode of "–" (not relevant), the charge supplying control of "X", "23° C. and 50%" and "one-face character printing" as other conditions were employed. The result of evaluation was "x". Thus, it was confirmed that the number of the manual cleanings was high since no spontaneous cleaning operation was performed.

COMPARATIVE EXAMPLE 2

The automatic performance condition of "C" (the cleaning operation was not automatically performed), the dependence on the character printing mode of "–" (not relevant), the charge supplying control of "Y", "10° C. and 15%" and "one-face character printing" as other conditions were employed. The result of evaluation was "x". Thus, it was confirmed that the number of the manual cleanings was high even though the charge providing control was relieved at the lower humidity, since no spontaneous cleaning operation was performed.

Additionally, the image forming apparatus according to the present invention is explained as a printer in the respective embodiments and examples. But it is not limited to the printer and may be also applied to an image forming apparatus such as a composite machine of printer, facsimile and copier. Further, it can be also applied to an image forming apparatus using a recording liquid other than ink or a fixing solution.

The present invention is not limited to the specifically disclosed embodiment, and variations and modifications may be made without departing from the scope of the present invention.

The present application is based on Japanese priority application No. 2004-347937 filed on Dec. 1, 2004, the entire contents of which are hereby incorporated by reference.

APPENDIX (1) An image forming apparatus comprising a recording head having a nozzle configured to eject a liquid drop of recording liquid so as to form an image on the recording-medium with a liquid drop ejected from the nozzle of the recording head, and a conveyer configured to electrostatically hold and convey a recording-medium by a charge provided to the conveyer, wherein the apparatus further comprises a cleaning device configured to clean a nozzle face of the recording head based on a tolerance threshold value of contamination on the nozzle face generated by the ejection of a liquid drop and the number of liquid drops ejected from the recording head for image formation.

(2) The image forming apparatus as described in (1) above, wherein the nozzle face of the recording head is cleaned according to a character printing mode.

(3) The image forming apparatus as described in (1) or (2) above, wherein the nozzle face of the recording head is cleaned according to an environmental condition.

(4) The image forming apparatus as described in any of (1) through (3) above, wherein the nozzle face of the recording head is cleaned according to a kind of the recording-medium.

(5) The image forming apparatus as described in any of (1) through (4) above, wherein the nozzle face of the recording head is cleaned according to a kind of the recording liquid.

(6) The image forming apparatus as described in any of (1) through (5) above, wherein the nozzle face of the recording head is not cleaned when the kind of the recording-medium is a predetermined kind.

(7) The image forming apparatus as described in any of (1) through (6) above, comprising a device configured to control a quantity of the charge provided to the conveyer according to at least one of an environmental condition and a kind of the recording-medium.

(8) The image forming apparatus as described in any of (1) through (7) above, which can form an image on both faces of the recording-medium, wherein the number of cleaning of the nozzle face of the recording head when an image is formed on a back face of the medium is less than the number of cleanings when an image is formed on a front face of the recording-medium.

(9) An image forming apparatus comprising a recording head having a nozzle configured to eject a liquid drop of recording liquid and a conveyer configured to electrostatically hold and convey a recording-medium by a charge provided to the conveyer, the image forming apparatus being capable of forming an image on both faces of the recording-medium with a liquid drop ejected from the nozzle of the recording head, wherein a frequency of cleaning of a nozzle face of the recording head when images are formed on both faces of the recording-medium is less than a frequency of cleaning of the nozzle face of the recording head when an image is formed on one face of the recording-medium.

The invention claimed is:

1. An image forming apparatus comprising:

a recording head having a nozzle configured to eject a liquid drop of recording liquid so as to form an image on a recording-medium with a liquid drop ejected from the nozzle of the recording head;

a conveyer configured to electrostatically hold and convey a recording-medium by a charge provided to the conveyer; and a cleaning device configured to clean a nozzle face of the recording head based on a tolerance threshold value of contamination of the nozzle face generated by the ejection of a liquid drop and the number of liquid drops ejected from the recording head during image formation with electrostatic conveyance that causes adhesion of charged mist on the nozzle face of the recording head, and the number of liquid drops not reflecting the number of ink drop ejections for preejection.

2. The image forming apparatus as claimed in claim 1, wherein the nozzle face of the recording head is cleaned according to a character printing mode.

3. The image forming apparatus as claimed in claim 1, wherein the nozzle face of the recording head is cleaned according to an environmental condition.

4. The image forming apparatus as claimed in claim 1, wherein the nozzle face of the recording head is cleaned according to a kind of the recording-medium.

5. The image forming apparatus as claimed in claim 1, wherein the nozzle face of the recording head is cleaned according to a kind of the recording liquid.

6. The image forming apparatus as claimed in claim 1, wherein the nozzle face of the recording head is not cleaned when the kind of the recording medium is a predetermined kind.

7. An image forming apparatus comprising:

a recording head having a nozzle configured to eject a liquid drop of recording liquid so as to form an image on a recording-medium with a liquid drop ejected from the nozzle of the recording head;

a conveyor configured to electrostatically hold and convey the recording-medium by a charge provided to the conveyor;

a cleaning device configured to clean a nozzle face of the recording head based on a tolerance threshold value of contamination of the nozzle face generated by the ejection of a liquid drop and the number of liquid drops ejected from the recording head for image formation; and a device configured to control a quantity of the charge provided to the conveyer according to at least one of an environmental condition and a kind of the recording-medium.

8. The image forming apparatus as claimed in claim 7, wherein the nozzle face of the recording head is cleaned according to a character printing mode.

9. The image forming apparatus as claimed in claim 7, wherein the nozzle face of the recording head is cleaned according to a kind of the recording-medium.

10. The image forming apparatus as claimed in claim 7, wherein the nozzle face of the recording head is cleaned according to a kind of the recording liquid.

11. An image forming apparatus comprising:

a recording head having a nozzle configured to eject a liquid drop of recording liquid so as to form an image on a recording-medium with a liquid drop ejected from the nozzle of the recording head;

a conveyor configured to electrostatically hold and convey the recording-medium by a charge provided to the conveyor; and a cleaning device configured to clean a nozzle face of the recording head based on a tolerance threshold value of contamination of the nozzle face generated by the ejection of a liquid drop and the number of liquid drops ejected from the recording head for image formation, wherein said image forming apparatus can form an image on both faces of the recording-medium, and the number of cleaning of the nozzle face of the recording head when an image is formed on a back face of the recording-medium is less than the number of cleanings when an image is formed on a front face of the recording-medium.

12. The image forming apparatus as claimed in claim 11, wherein the nozzle face of the recording head is cleaned according to a character printing mode.

13. The image forming apparatus as claimed in claim 11, wherein the nozzle face of the recording head is cleaned according to an environmental condition.

14. The image forming apparatus as claimed in claim 11, wherein the nozzle face of the recording head is cleaned according to a kind of the recording-medium.

15. The image forming apparatus as claimed in claim 11, wherein the nozzle face of the recording head is cleaned according to a kind of the recording liquid.

16. An image forming apparatus comprising a recording head having a nozzle configured to eject a liquid drop of recording liquid and a conveyer configured to electrostatically hold and convey a recording-medium by a charge provided to the conveyer, the image forming apparatus being capable of forming an image on both faces of the recording-medium with a liquid drop ejected from the nozzle of the recording head, wherein a frequency of cleaning of a nozzle face of the recording head when images are formed on both faces of the recording-medium is less than a frequency of cleaning of the nozzle face of the recording head when an image is formed on one face of the recording-medium.

17. The image forming apparatus as claimed in claim 16, wherein the nozzle face of the recording head is cleaned according to a character printing mode.

18. The image forming apparatus as claimed in claim 16, wherein the nozzle face of the recording head is cleaned according to an environmental condition.

19. The image forming apparatus as claimed in claim 16, wherein the nozzle face of the recording head is cleaned according to a kind of the recording-medium.

20. The image forming apparatus as claimed in claim 16, wherein the nozzle face of the recording head is cleaned according to a kind of the recording liquid.

* * * * *